US007726517B2

(12) United States Patent
Kennedy et al.

(10) Patent No.: US 7,726,517 B2
(45) Date of Patent: Jun. 1, 2010

(54) LIQUID DRAW-BACK SYSTEM FOR A DISPENSING PACKAGE

(75) Inventors: Timothy Kennedy, Pleasanton, CA (US); Tami O'Connell, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 350 days.

(21) Appl. No.: 11/769,610

(22) Filed: Jun. 27, 2007

(65) Prior Publication Data

US 2009/0001099 A1 Jan. 1, 2009

(51) Int. Cl.
*B05B 1/14* (2006.01)

(52) U.S. Cl. ..... 222/108; 222/205; 222/321.3; 222/321.6

(58) Field of Classification Search ..... 222/108, 222/205, 321.3, 321.6
See application file for complete search history.

(56) References Cited

U.S. PATENT DOCUMENTS 2,593,591 A * 4/1952 Benjamin et al. ..... 222/205
2,774,517 A * 12/1956 Teegardin et al. ..... 222/205
3,739,955 A * 6/1973 Gores ..... 222/205
4,146,154 A * 3/1979 Mastman ..... 222/109
4,978,035 A * 12/1990 Morane et al. ..... 222/108
4,986,453 A 1/1991 Lina et al.
5,181,635 A 1/1993 Balderrama
5,242,089 A 9/1993 Knickerbocker et al.
5,360,127 A 11/1994 Barriac et al.
5,445,299 A 8/1995 Harriman
5,544,789 A 8/1996 Gillingham
5,549,223 A * 8/1996 Hori ..... 222/321.3
5,593,094 A 1/1997 Barriac
5,664,703 A * 9/1997 Reifenberger et al. .... 222/321.7
5,720,419 A 2/1998 Li
5,732,855 A * 3/1998 van der Heijden ..... 222/402.12
5,738,250 A 4/1998 Gillingham
5,785,208 A 7/1998 Grogan et al.
6,045,008 A 4/2000 Gonzalez Fernandez et al.
6,158,625 A 12/2000 Siegel et al.
6,158,674 A * 12/2000 Humphreys ..... 222/321.6
6,173,863 B1 1/2001 Brozell et al.
6,173,868 B1 1/2001 DeJonge
6,223,951 B1 5/2001 Siegel et al.
6,257,451 B1 7/2001 Siegel et al.

(Continued)

FOREIGN PATENT DOCUMENTS

WO WO 9110607 A * 7/1991

OTHER PUBLICATIONS http://www.saint-gobain-calmar.com/products.aspx?c=prod&sc=2&pid=20 (Calmar MD3200)—Oct. 19, 2006.

*Primary Examiner*—Kenneth Bomberg
(74) *Attorney, Agent, or Firm*—Daid Peterson

(57) ABSTRACT

Provided is a liquid dispensing package for a container adapted to contain a liquid that includes a hand operated liquid transport assembly coupled to an actuator, a liquid distribution subsystem in fluid communication with a discharge tube from the liquid transport assembly, wherein downward motion of the actuator, provided by a user, causes liquid to travel through the discharge tube to the actuator top surface, and a liquid draw-back subsystem wherein upward motion of the actuator, provided by a return spring, permits draw-back of liquid from the top surface of the actuator.

3 Claims, 13 Drawing Sheets

U.S. PATENT DOCUMENTS

| | | | |
|---|---|---|---|
| 6,269,976 | B1 | 8/2001 | DeJonge |
| 6,338,422 | B1 | 1/2002 | DeJonge |
| 6,474,508 | B1 | 11/2002 | Marsh |
| 6,543,649 | B1 | 4/2003 | Danielo et al. |
| 6,695,171 | B2 | 2/2004 | Walters et al. |
| 6,702,157 | B1 | 3/2004 | Dobbs |
| 6,716,805 | B1 | 4/2004 | Sherry et al. |
| 6,729,500 | B1 | 5/2004 | Dobbs et al. |
| 6,779,693 | B2 | 8/2004 | Sweeton et al. |
| 6,953,297 | B2 | 10/2005 | Dobbs |
| 2001/0025863 | A1 | 10/2001 | Lorscheidt et al. |
| 2003/0192913 | A1 | 10/2003 | Prueter |
| 2005/0100391 | A1 | 5/2005 | Dobbs et al. |
| 2005/0224515 | A1 | 10/2005 | Mon et al. |
| 2008/0135581 | A1 | 6/2008 | Kennedy et al. |
| 2008/0138143 | A1 | 6/2008 | O'Connell et al. |
| 2008/0138144 | A1 | 6/2008 | Kennedy et al. |
| 2008/0166174 | A1 | 7/2008 | Kennedy et al. |
| 2008/0314925 | A1 | 12/2008 | Kennedy et al. |

* cited by examiner

20

20

LIQUID DRAW-BACK SYSTEM FOR A DISPENSING PACKAGE

BACKGROUND OF THE INVENTION

1. Field of the Invention

This invention relates to liquid pump dispensers for use with substrates such as paper towels, wipes, woven or non-woven dishcloths, and sponges. More specifically the present invention relates to a dispensing package having a suction-flow liquid draw-back subsystem from a dispensing package actuator to the dispensing package liquid distribution subsystem used to distribute liquid from a dispensing package container to the actuator.

2. Description of the Related Art

Consumers have traditionally applied cleaning and disinfecting compositions with a dispenser, sometimes called a dispensing package. For example, in a cleaning process, a consumer applied the composition from a trigger spray bottle dispenser by spraying the composition on a surface and wiping it with a paper towel. Alternatively, the composition in a pour or pump-out bottle dispenser was added to a sponge, activated with water, and wiped on and rinsed off the surface with the sponge. These procedures and cleaning systems are inefficient because the consumer must go through several cleaning steps.

As an alternative to spray, pump-out, and pour dispensed cleaning systems, wet disinfectant or cleaning wipes, such as described in U.S. Pat. No. 6,716,805 to Sherry et al., are becoming increasingly popular for their convenience in combining a nonwoven, disposable substrate with a disinfecting or cleaning composition. Soap-loaded disposable dish cloths, as described in U.S. Pat. No. 6,652,869 to Suazon et al., are also popular for their convenience. These products combine the cleaning composition and the cleaning substrate in one cleaning system so that the consumer can perform the cleaning task with one hand and with one product. However, these systems have some drawbacks such as requiring water activation of a dry substrate or requiring a sealed packaging for a wet substrate.

Current dispensing packages, however, are not adequate for one hand application of cleaning and disinfecting compositions to cleaning substrates such as paper towels. Dispensing packages such as trigger sprayers or pump dispensers generally require one hand to hold and activate the dispenser and one hand to hold the cleaning substrates. Existing pump-up dispensers that can be ergonomically operated with the same hand that holds the cleaning substrate have small actuators that require the hand and substrate to be contracted into a ball in order to activate the dispenser. To overcome the problem that existing pump-up dispensers having small actuators that require the hand and substrate to be contracted into a ball in order to activate the dispenser is address in co-owned patent application Ser. No. 11/609,740 now U.S. App. 2008/0138143; Ser. No. 11/609,749 now U.S. App. 2008/0138144, Ser. No. 11/609,761 now U.S. App. 2008/0135581, and Ser. No. 11/621,235 now U.S. App. 2008/0166174 each of which is incorporated by reference in their entirety. These co-owned patent applications describe dispensing package liquid distribution subsystems that distribute a liquid at the entire top surface area of a large, hand-sized actuator so that the hand and substrate need not be contracted into a ball in order to operated the dispensing package.

Further, while gravity-flow liquid drain-back features are very common for bottle/spout systems for laundry aisle products, existing pump-up dispensing packages do not provide a drain-back subsystem that returns excess dispensed cleaning compositions not absorbed by the cleaning substrate. Some pump mechanisms and dispensers specifically prevent liquid from draining back into the liquid container of the dispensing package or from being drawn back into the liquid distribution subsystem of the dispensing package. This may be important for disinfecting or registered cleaning compositions.

However, it would often be desirable with other compositions or liquids, to collect excess dispensed product, not fully absorbed by the substrate at the actuator top surface, and return it to the composition product container of the dispensing package. Where product drain-back into the container would not compromise the integrity of the product, this excess liquid collection and return feature would aid in the use, appearance, and efficiency of the dispensing package and would help prevent product drooling. Preventing product drooling or pooling on a dispenser surface would be an aesthetic benefit to the consumer.

Embodiments of a gravity-flow liquid drain-back subsystem are disclosed in co-owned patent application Ser. No. 11/767,646 now U.S. App. 2008/0314925, which is incorporated by reference in its entirety. The gravity-flow liquid drain-back system returns excess liquid not absorb by the substrate during actuation of a pump-up dispensing package to the container from which the liquid product is dispensed. A drain-back pathway, separate from the liquid distribution system pathway, is utilized to drain excess liquid back to the dispensing package container. It would be desirable to provide an excess liquid collection subsystem for a dispensing package which avoids the separate return pathway of the gravity-flow liquid drain-back subsystem.

To overcome these problems of prior art cleaning systems, the dispensing package embodiments of the present invention are designed to provide a dispensing package that allows a consumer to conveniently apply a liquid cleaning composition from a container to a substrate with one hand and in a controlled manner. Further, the dispensing package embodiments of the present invention are designed to provide a dispensing package that allows for the collection and return of excess liquid cleaning composition not absorbed by the substrate without the need for a liquid pathway separate from the liquid pathway used to apply the liquid cleaning composition to the substrate.

SUMMARY OF THE INVENTION

Embodiments of the present invention provide a liquid dispensing package that includes a container adapted to contain a liquid and an actuator having an actuator top with at least one discharge orifice therethrough. An actuator top surface of the actuator top, is in fluid communication with the container through the one or more discharge orifices to permit flow of liquid from the container to the actuator top surface upon reciprocation of the actuator. Further, the at least one discharge orifice is in fluid communication with a suction device to permit flow of liquid from the top surface of the actuator through the at least one discharge orifice upon reciprocation of the actuator.

In accordance with an object of the present invention and those that will be mentioned and will become apparent below, one aspect of the present invention is a dispensing package that includes a hand operated liquid transport assembly having a pressure component and a suction component and coupled to the actuator, a liquid distribution subsystem comprising a discharge tube from the liquid transport assembly, wherein depression of the actuator causes liquid to travel through the discharge tube to the actuator top surface. The liquid distribution subsystem delivers liquid to an area of the actuator top surface greater than the circumferential area of the discharge tube The liquid distribution subsystem of the dispensing package may include a manifold type distribution subsystem, a spray type distribution subsystem, or a surface distribution channel type distribution subsystem. Various liquid distribution pathways from the container to the actuator top surface are utilized.

Another aspect of the present invention a dispensing package that includes a suction device, coupled to the actuator, a liquid draw-back subsystem wherein return of the actuator causes liquid to flow from the actuator top surface to the liquid distribution system.

The suction-flow liquid draw-back subsystem of the dispensing package may include a piston type draw-back subsystems, a bellows type draw-back subsystem, or a flexible membrane type draw-back subsystem. The liquid drawback pathway from the actuator top surface is a portion of the liquid distribution pathway utilized to deliver liquid to the actuator top surface.

DETAILED DESCRIPTION OF THE INVENTION

Figure 1:
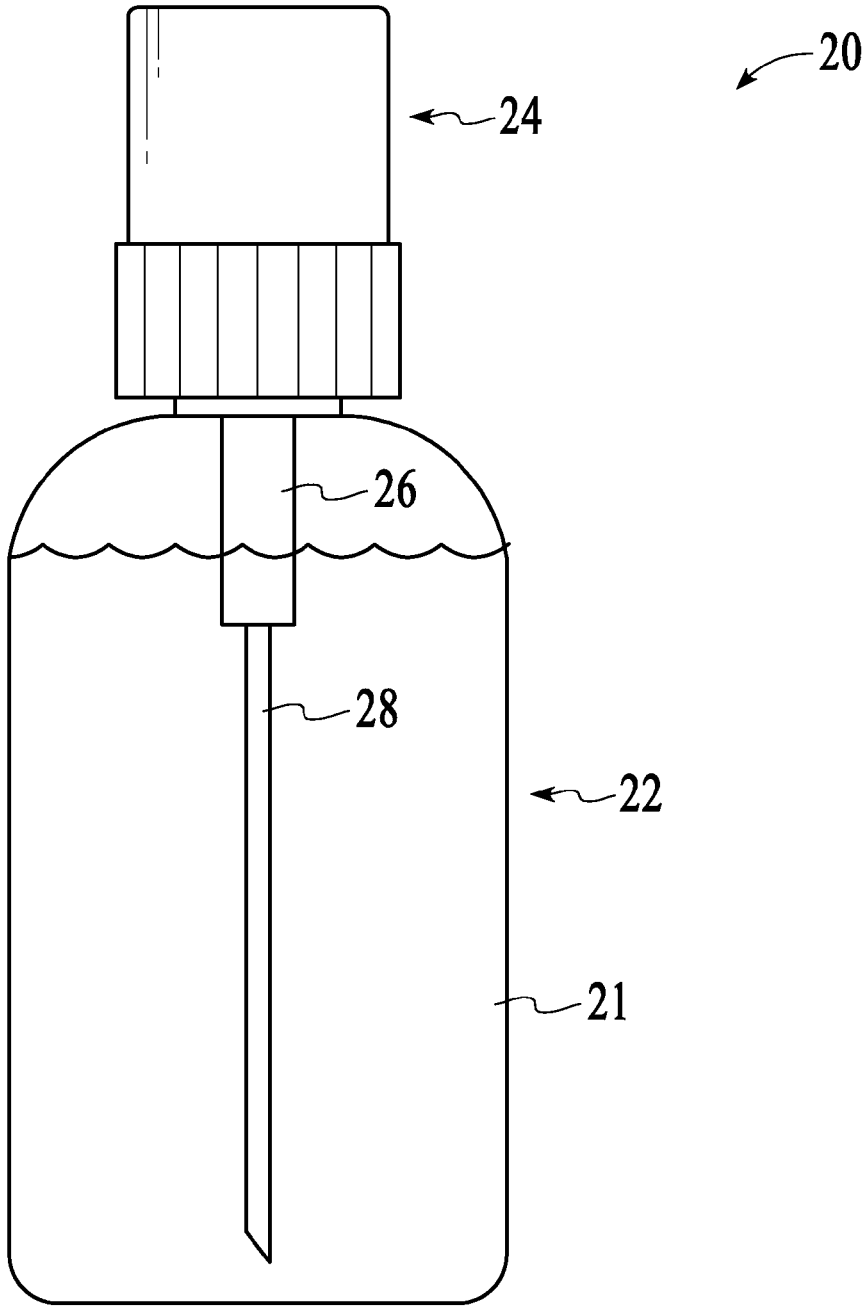
FIG. 1 is a front view of a first embodiment of a dispensing package of the present invention with the package shown assembled in a condition prior to use.

While this invention is susceptible of embodiment in many different forms, this specification and the accompanying drawings disclose only some specific forms as examples of the invention. The invention is not intended to be limited to the embodiments so described. It is also to be understood that the terminology used herein is for the purpose of describing particular embodiments of the invention only, and is not intended to limit the scope of the invention in any manner. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. All percentages, ratios and proportions are by weight, and all temperatures are in degrees Celsius (° C.), unless otherwise specified. All measurements are in SI units, unless otherwise specified. Unless otherwise stated, amounts listed in percentage ("%'s") are in weight percent (based on 100% active) of the cleaning composition alone. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic and/or amphoteric agents.

The composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

Dispensing Package

FIG. 1 illustrates a dispensing package 20 employing an actuator 24, a liquid transport assembly 26, and a dip tube 28 installed on a container 22. In this embodiment, the container 22 is transparent and contains a cleaning composition liquid 21.

Figure 2:
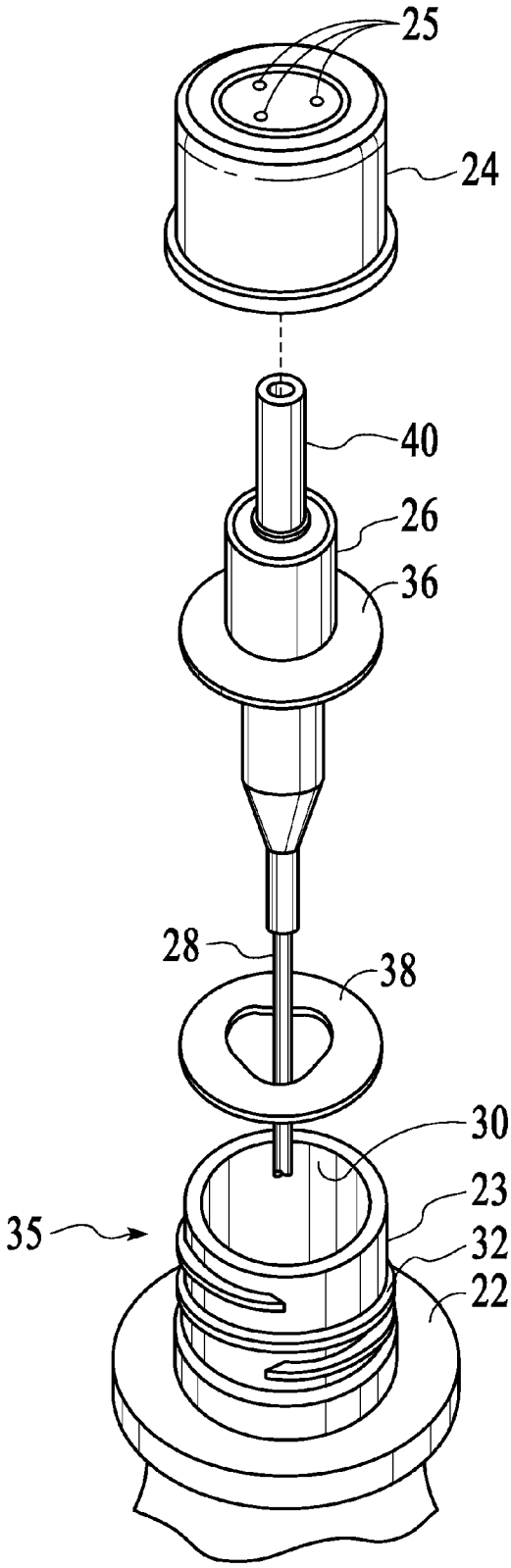
FIG. 2 is a fragmentary, exploded, perspective view of the package illustrated in FIG. 1.

FIG. 2 illustrates a typical liquid transport assembly 26 that may be employed on the container 22 and which is adapted to be mounted in the neck 23 of the container 22. The exterior of the container neck 23 typically defines container threads 32 for engaging a closure 34 (FIG. 4A) as described hereinafter. The container threads 32 define a container connection feature 35 adjacent the container mouth 30. Other connection features may be employed in cooperation with mating or cooperating closure connection features 48 (FIG. 4A) on the closure 34. Other container and closure connection features could include a snap-fit bead and groove arrangement or other conventional or special connection features, including non-releasable connection features such as adhesive, thermal bonding, staking, etc. The dispensing package may be disposable and designed for one use and not designed to be refillable. In the embodiment of FIG. 1 for example, the actuator 24 and/or liquid transport assembly 26 may be fused to the container 22, for example with spot welding.

A part of the liquid transport assembly 26 may extend into the container opening or mouth 30. The bottom end of the liquid transport assembly 26 is attached to a conventional dip tube 28, and the upper end of the liquid transport assembly projects above the container neck 23. The liquid transport assembly 26 includes an outwardly projecting flange 36 for supporting the liquid transport assembly 26 on the container neck 23 over a conventional sealing gasket 38 which is typically employed between the liquid transport assembly flange 36 and container neck 23. Other sealing designs such as plug seals can be used in place of a gasket. The hollow stem or discharge tube 40 establishes communication between a pump chamber 33 (FIG. 5A) within the liquid transport assembly 26 and an actuator 24 which is mounted to the upper end of the discharge tube 40.

The actuator 24 has a hand-and-substrate engageable region and can be depressed by the user's hand containing a substrate, such as a sponge, to move the discharge tube 40 downwardly in the liquid transport assembly 26 to dispense liquid from the liquid transport assembly 26. The liquid is pressurized in the liquid transport assembly chamber 33 (FIG. 5A) and exits from the actuator discharge orifices 25 (FIG. 2) in the actuator 24.

It will be appreciated that the particular design of the liquid transport assembly 26 may be of any suitable design for pumping a product from the container 22 (with or without a dip tube 28) and out through the discharge tube 40. The detailed design and construction of the liquid transport assembly 26 per se forms no part of the present invention except to the extent that the liquid transport assembly 26 is adapted to be suitably coupled and held on the container 22 with a suitable mounting system.

Figure 5A:
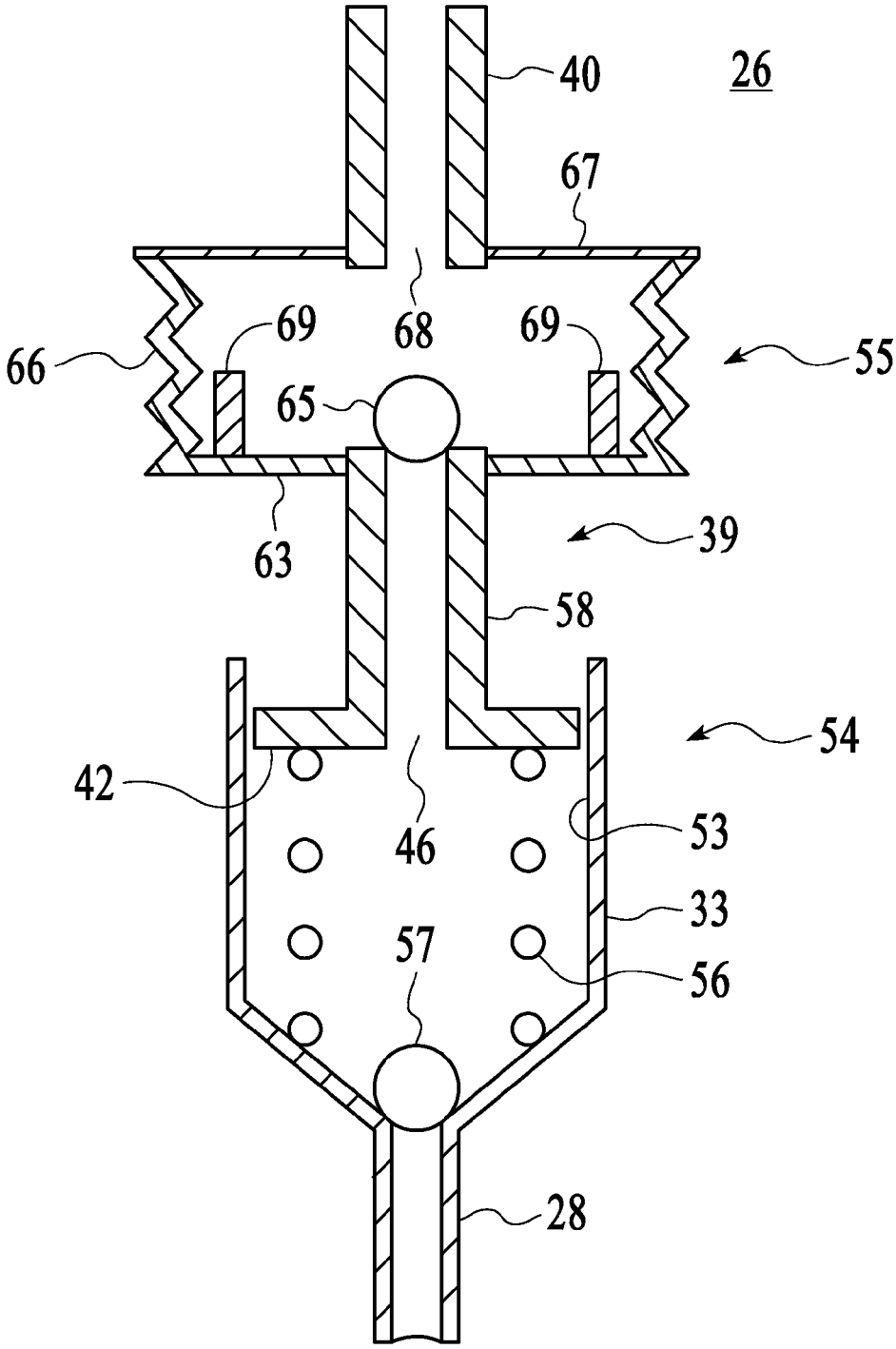
FIG. 5A shows a schematic side cross-sectional view of a liquid transport assembly for the dispensing package of FIG. 4A.
Figure 5B:
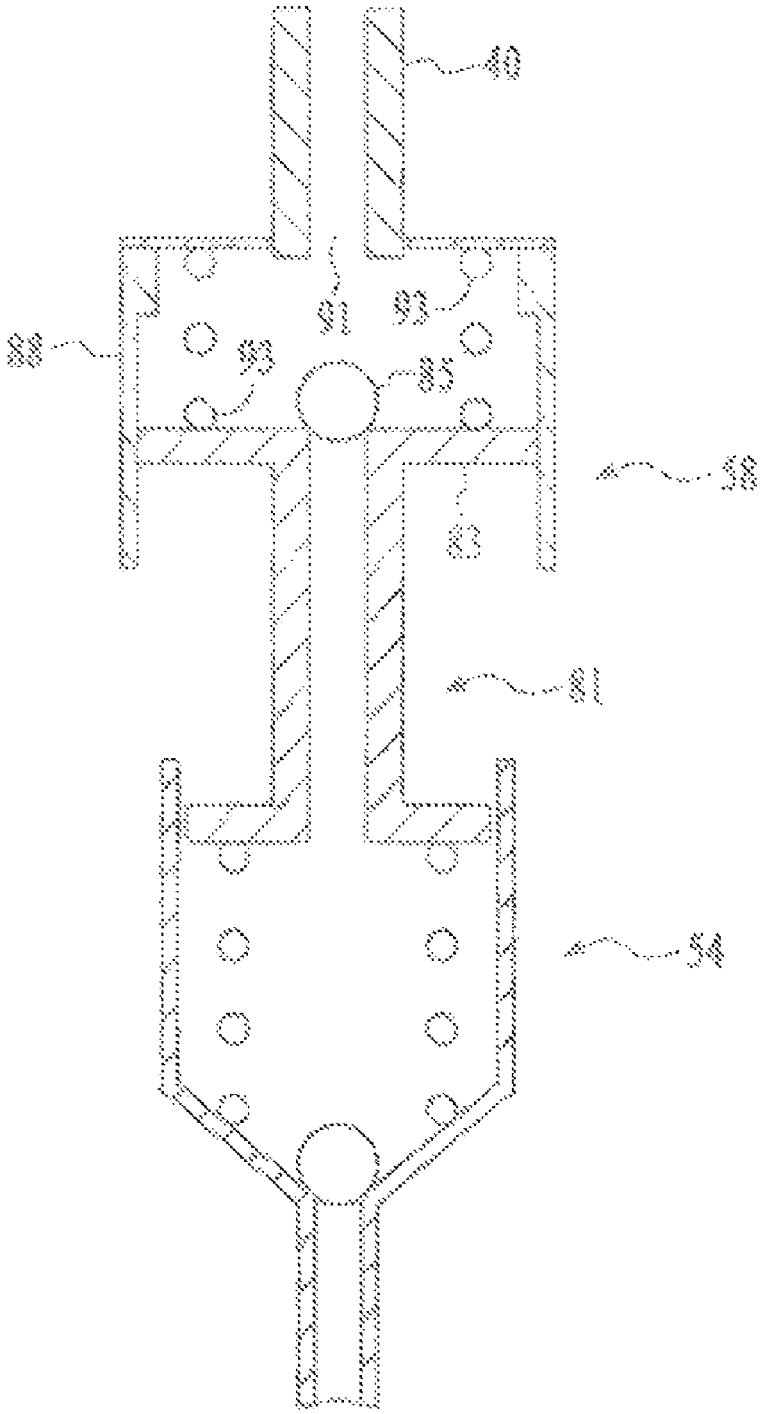
FIG. 5B shows a schematic side cross-sectional view of another liquid transport assembly for the dispensing package of FIG. 4A.

As described in detail below with reference to FIGS. 5A and 5B, in some embodiments, the liquid transport assembly 26 includes two components, namely, a pressure component 54 and a suction component 55 (FIG. 5A), or 57 (FIG. 5B). While the present invention may be practiced with the pressure components 54 as liquid pumps of many different designs, the internal design configuration of one suitable pressure component of the liquid transport assembly 26 is generally disclosed in U.S. Pat. No. 4,986,453, the disclosure of which is hereby incorporated herein by reference thereto. It should be understood, however, that the present invention is suitable for use with a variety of hand-operable pressure components.

Container

Figure 3:
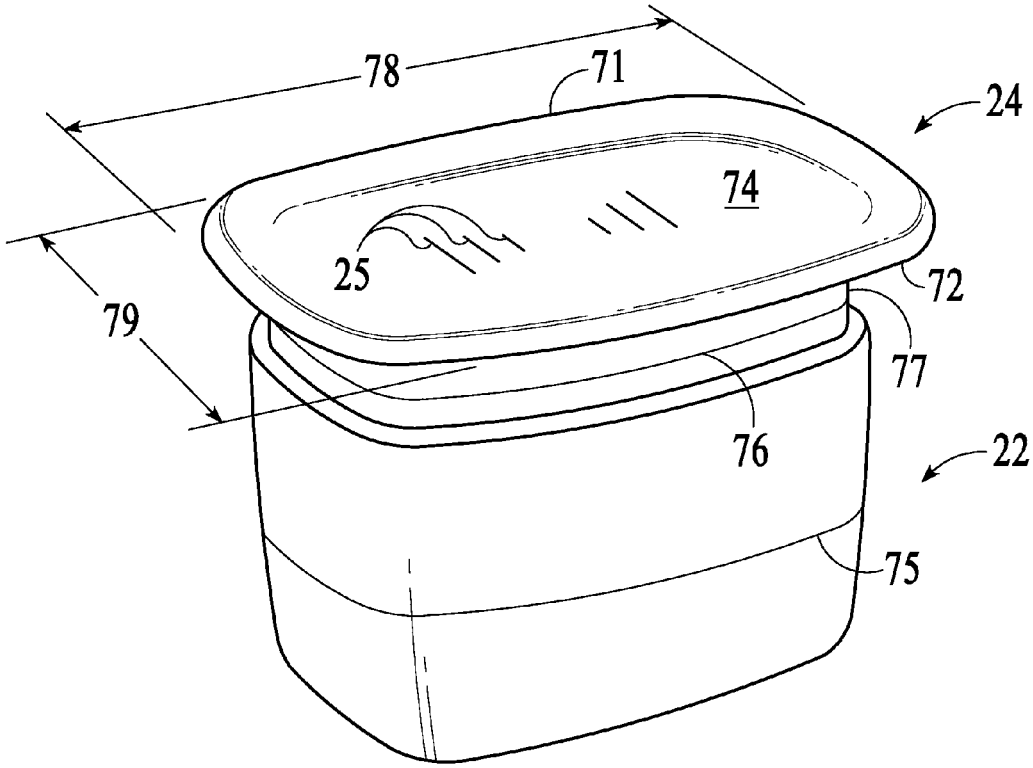
FIG. 3 is a perspective view of another embodiment of a dispensing package of the present invention with the package shown assembled in a condition prior to use.
Figure 4A:
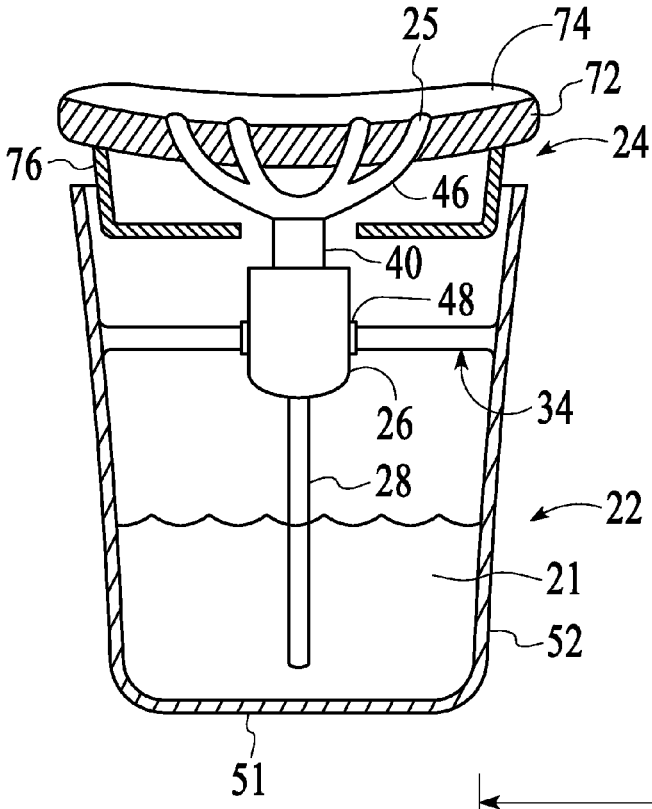
FIG. 4A shows a side cross-sectional view of another embodiment of a dispensing package of the present invention having a liquid distribution subsystem and a suction-flow liquid draw-back subsystem.

FIG. 3 is a perspective view of another embodiment of a dispensing package of the present invention with the package shown assembled in a condition prior to use. FIG. 4A shows a side cross-sectional view of another embodiment of a dispensing package of the present invention having a liquid distribution subsystem and a suction-flow liquid draw-back subsystem. Referring to FIGS. 3 and 4A together, embodiments of the dispensing package 20 can comprise a container 22 adapted to contain a liquid 21 the container 22 having a container bottom 51; a container sleeve 52 coupled to the container bottom 51 and depending upwardly from the peripheral edge of the container bottom 51; an actuator 24 having an actuator top 72 with an actuator top surface 74 and an actuator skirt 76 coupled to the actuator top 72 and depending downwardly from the peripheral edge of the actuator top 72; wherein a sleeve interior surface of the container sleeve 52 is slideably engagable with a skirt exterior surface 77 of the actuator skirt 76; a liquid transport assembly 26 including a pressure component 54 (FIG. 5A) and a suction component 55 (FIG. 5A) is in fluid communication with the pressure component and having a hollow discharge tube 40, the liquid transport assembly 26 being disposed within the container 22 and in fluid communication with the actuator 24; wherein the actuator 24 has at least one discharge orifice 25 in fluid communication with the container 22 through the discharge tube 40 of the liquid transport assembly 26 to permit liquid to flow onto the actuator top surface 74 of the actuator top 72 upon reciprocation of the actuator top 72; and wherein the at least one discharge orifice 25 is in fluid communication with the suction component 55 (FIG. 5A) to permit flow of liquid from the actuator top surface 74 back through the at least one discharge orifice 25 upon reciprocation of the actuator 24.

The container 22 can have a variety of shapes. The container can be round or oval or rectangular with rounded corners as shown in FIG. 3. The container dimensions can be measured from a horizontal slice 75 of the container 22 The container can be made from plastic materials. The container, and other components of the dispensing package, can be constructed of any of the conventional material employed in fabricating containers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A suitable container is made of clear material, e.g., polyethylene terephthalate.

Actuator

The ergonomic shape of the actuator 24 makes the actuator easy to be a liquid transport assembly with a substrate such as paper towel or sponge, and to operate using one hand. One measure of the actuator shape is a vertical projection 71 (FIG. 3) of the actuator top surface 74 of the actuator top 72, where a vertical projection is a projection onto the horizontal plane. The vertical projection 71 has a length 78 and a width 79. The aspect ratio is the ratio of the length to the width. For a circle, the aspect ratio would be 1. Unless the hand or the substrate in the hand is severely compressed, then both the hand and substrate would have an aspect ratio greater than 1. In order to ergonomically apply the composition to the substrate in the hand, in some embodiments of the invention it would be desirable for the actuator and or the pattern of orifices to have an aspect ratio greater than 1. The vertical projection of the actuator top can have an aspect ratio of greater than 1, or greater than 1.1, or greater than 1.2, or greater than 1.5, or at least 1.1, or at least 1.2, or at least 1.5, or less than 2, or less than 1.5. In order to provide a large surface for one-handed use of the dispensing package, in some embodiments, the actuator top size can be approximately the same size or larger than the container. The actuator top size can be larger than the width of two fingers for easy ergonomic use with a cleaning substrate. The vertical projection of the actuator top length can be larger than about 1.5 inches, or from 2 to 10 inches, or from 2 to 8 inches, or from 2 to 5 inches, or from 2 to 3 inches, or from 2.5 to 8 inches, or from 2.5 to 5 inches, or from 2.5 to 3 inches. The vertical projection of the actuator top can have an area of greater than 2 square inches, greater than 5 square inches, greater than 6 square inches, greater than 7 square inches, greater than 8 square inches, greater than 10 square inches, less than 8 square inches, less than 10 square inches, or less than 20 square inches. For use with a semi-rigid rectangular substrate, for example a sponge, the actuator top can be approximately the same size or somewhat smaller than a standard rectangular sponge, for example about 2.5 by about 4.5 inches. The vertical projection of the top surface of the actuator top can have at least one dimension that is greater than the corresponding dimension of any horizontal slice 75 of the container (FIG. 3).

The actuator top 72 can have a concave shape that is round, oval, a rectangular with rounded corners as shown in (FIG. 3), elliptical, or other shape that fits the hand, a sponge, or other substrate. The concave shape allows the capture of excess composition without dripping. The actuator can have a rim 41 to prevent spillage. In certain embodiments, it may be useful for the actuator to be substantially flat or convex for ergonomic effectiveness with certain substrates.

Figure 7:
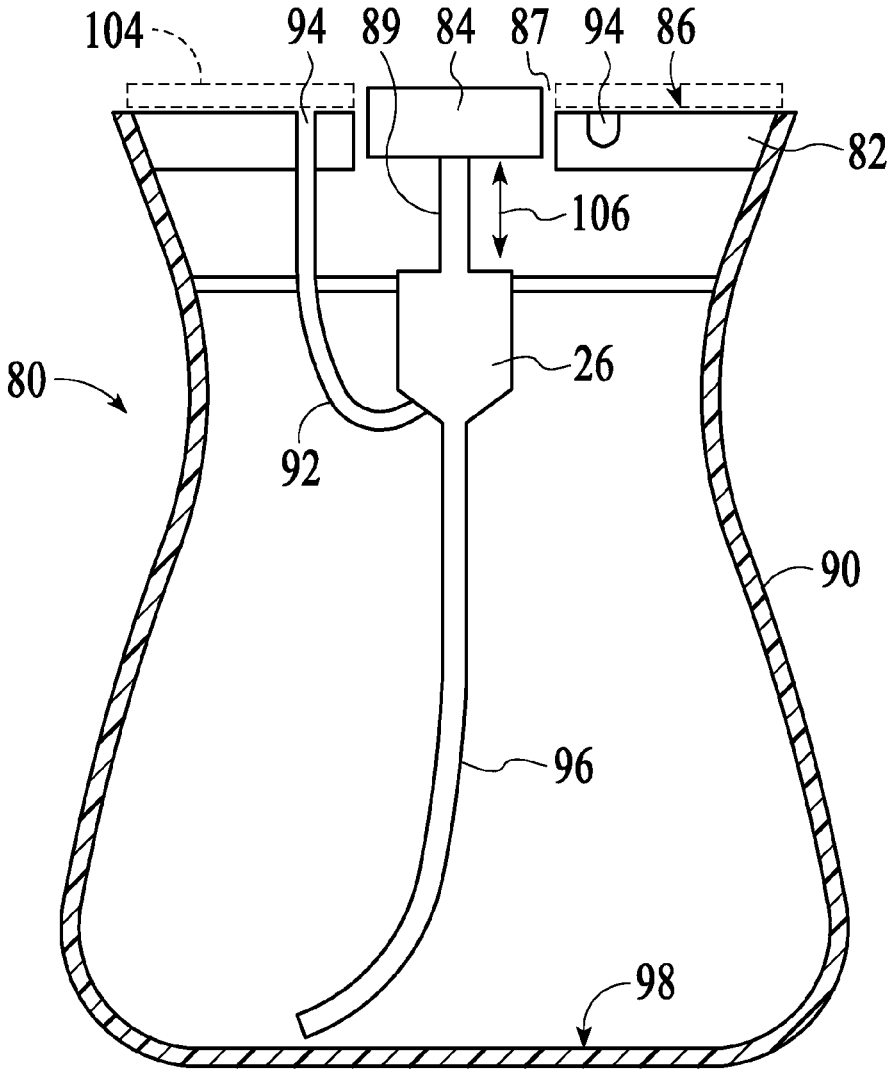
FIG. 7 shows a side cross-sectional view of another embodiment of a dispensing package of the present invention having a liquid distribution subsystem and a suction-flow liquid draw-back subsystem.

The actuator can individually be adapted to the respective requirements with regard to the direction of the discharge orifice as well as with regard to the use of opening valves. The actuator is not limited to having a discharge orifice 25 which moves together with the actuator, but it may also comprise an actuator of the type having a stationary discharge orifice 25, as shown in FIG. 7. The actuator may have a surface that slideably engages the container and is internal or external to the container.

Actuator Discharge Orifices

As noted above, the dispensing package can have one or more openings or discharge orifices 25 situated on the actuator 24 (for example FIGS. 2, 3 and 4A). The discharge orifices 25 can be a small or large, round, slit or other suitable shape. The discharge orifice or orifices 25 can be centered in the actuator. Because the actuator is enlarged, the discharge orifices or orifices can be located away from the edge of the actuator to prevent, for example, spilling the composition. The actuator top can have multiple discharge orifices and the discharge orifices can be indented from the exterior edge of the top surface of the actuator top. The actuator top can have multiple discharge orifices wherein the pattern of discharge orifices has an aspect ratio of at least 1.5, or greater than 1, or greater than 1.1, or greater than 1.2, or greater than 1.5, or at least 1.1, or at least 1.2, or less than 2, or less than 1.5. Where the pattern of discharge orifices has an aspect ratio of at least 1.5, then the composition can be applied to the substrate in an area having an aspect ratio of at least 1.5, or greater than 1, or greater than 1.1, or greater than 1.2, or greater than 1.5, or at least 1.1, or at least 1.2, or less than 2, or less than 1.5. When for example the actuator top is large and has multiple discharge orifices, the actuator can apply at least 0.3 ml of the composition (or other volume) to the substrate in an area of greater than 2 square inches and less than 20 square inches, or an area of greater than 4 square inches, greater than 5 square inches, greater than 6 square inches, greater than 7 square inches, greater than 8 square inches, greater than 10 square inches, less than 8 square inches, less than 10 square inches, or less than 20 square inches.

Liquid Transport Assembly

For the purpose of the discussion below liquid pumps may be described as "pressure" components or "suction" components. Those of skill in the art recognize that pumps are both pressure generating devices, at their outlet, and suction generating devices, at their inlet. The liquid pumps described are characterized as pressure or suction components based on their primary use in the dispensing packages of the present invention. FIG. 5A shows a schematic side cross-sectional view of a liquid transport assembly for the dispensing package of FIG. 4A. As shown in FIG. 5A, liquid transport assembly 26 includes two main components, a pressure component 54 and a suction component 55.

Referring to FIGS. 4A and 5A together, in one embodiment, pressure component 54 operates as a conventional piston pump and includes the pump chamber 33 configured as a cylinder. The primary use of the pressure component 54 is as a pressure pump to deliver a liquid from a container to an actuator top surface such as the container 22 and actuator top surface 74 of the dispensing package shown in FIG. 4A. A pump piston 39, which includes a piston head 42 configured as a disk-like plate having a piston opening 46 therethrough, fits within the pump chamber 33. The piston opening 46 primarily functions as the outlet of the pressure component 54. The peripheral edge of the piston head 42 is in abutting contact with the pump chamber sidewall 53 to form a substantially liquid tight seal. The piston head 42 is coupled to the bottom end of a hollow stem or interconnect tube 58 and a bellows base 63 of the suction component 55 is coupled to the top end of the interconnect tube 58. The interconnect tube 58 is fluidly coupled with the piston opening 46 and is adapted to transport liquid from the pressure component 54 to the suction component 55.

Turning now to the suction component 55 of the liquid transport assembly 25, the suction component 55 operates as a conventional bellows pump. The primary use of the suction component 55 is to draw-back liquid into discharge orifices of an actuator top surface such as discharge orifices 25 and actuator top surface 74 of the dispensing package shown in FIG. 4A. Suction component 55 includes a bellows base 63 having a bellows base opening 64 therethrough. As described more fully below, bellows base 63 includes one or more bellow stops 69 intended to limit downward motion of a bellows top 67 relative to bellows base 63. As shown in FIG. 4A, the bellows base opening 64 is fluidly coupled to the interconnect tube 58. One end of a flexible and resilient bellows sidewall 66 is coupled to and circumscribes the peripheral edge of the bellows base 63 and the opposite end of the bellows sidewall 66 is coupled to and circumscribes the peripheral edge of the bellows top 67. The bellows top 67 has a bellows top opening 68 therethrough. Bellows top opening 68 is fluidly coupled to discharge tube 40. Together bellows base 63, bellows sidewall 66, and bellows top 67 make a bellows pump adapted to draw back liquid. As described more fully below, bellows top opening 68 function primarily as in inlet of the bellows pump.

Upon application of a downwardly directed force on the actuator 24 (FIG. 4A) discharge tube 40, coupled to actuator 24, also moves downwardly. In turn, the flexible resilient material of bellows sidewall 66 is compressed and liquid is displaced and made to flow through discharge tube 40 to discharge orifices 25 of actuator 24. Pump outlet check ball 65 prevent liquid from flowing out the interconnect tube 58. Advantageously, upon release of the downwardly direct force on the actuator 24, the resilient bellows sidewall 66 provide an upwardly directed force on bellows top 67 that expands the bellows sidewall 66 to create suction at bellows top opening 68 that draws back liquid from discharge orifices 25 into discharge tube 40.

Liquid Distribution Subsystem and Liquid Draw-back Subsystem

The actuator 24 defines a discharge passage through which the product from the stem or discharge tube 40 is discharged. The actuator 24 has a hand-and-substrate engageable region and can be depressed by the user's hand containing a substrate, such as a sponge, to move the discharge tube 40 downwardly in the liquid transport assembly 26 to dispense liquid from the liquid transport assembly 26. The liquid is pressurized in the pump chamber 33 and exits from the actuator discharge orifices 25 (FIG. 2) in the actuator 24.

When the actuator discharge covers a large area, it may be desirable to have a liquid distribution subsystem to deliver the liquid from the hollow discharge tube 40 delivered from container 22 by the liquid transport assembly 26 to the discharge orifices 25. As described in more detail below with reference to FIG. 4A through FIG. 12B, the liquid distribution subsystems of the present invention may include, for example, a manifold type distribution subsystem, a spray type distribution subsystem, or a surface distribution channel type distribution subsystem. Irrespective of the particular foregoing subsystem, the liquid distribution subsystem of the present invention may deliver liquid to an area of the top surface of an actuator top greater than the circumferential or cross-sectional area of the discharge tube 40. As used herein, the term "liquid distribution subsystem" refers to a system for dispensing a liquid delivered to the system (such as by liquid transport assembly 26) to a desired location (such as the top surface 74 of an actuator top 72).

Further, it may also be desirable to provide a suction-flow liquid draw-back subsystem to return excess liquid not absorbed on a substrate to a portion of the distribution subsystem. As, also described in more detail below with reference to FIG. 4A through FIG. 12B, the suction-flow liquid draw-back subsystems of the present invention may include, for example, a piston suction type draw-back subsystem or an bellows suction type draw-back subsystem.

In one embodiment the suction-flow liquid draw-back subsystem includes the at least one distribution orifice 25 of the liquid distribution system on the actuator top surface 74 that are in fluid communication the distribution tube 40. While liquid is permitted to flow from the container 22 to the actuator top surface 74 upon application of downwardly directed force on the actuator 24, liquid is permit flow from the actuator top surface 74 through the discharge orifices 25 upon released of downward force and resilient spring return of the actuator 24 distributed by the liquid distribution subsystem when actuator 24 is pressed downwardly. The distribution orifices 25 are in fluid communication with the suction component 55 to provide draw-back suction upon resilient spring return of the actuator 24. Thus the distribution orifices 25 both deliver liquid to the actuator top surface 74 and draw back liquid from the actuator top surface 74 along the same pathway upon full reciprocation of actuator 24.

Operation of the Dispensing Package

More particularly, FIG. 4A shows a cross-sectional view of an embodiment of a dispensing package 20 having a liquid distribution subsystem and a suction-flow liquid draw-back subsystem. Dispensing package 20 includes a manifold type distribution subsystem having discharge channels 45, fluidly coupled via discharge tube 40 to the liquid transport assembly 26 installed on a container 22 by a closure 34 on the container 22. The closure 34 isolates stored liquid 21 in the container 22 to a space below the closure 34, allowing liquid to exit the container 22 only via liquid transport assembly 26 and, more specifically, through discharge tube 40 and discharge channels 45. In the embodiment shown, the closure 34 is a dome or disk-like structure coupled to the perimeter sidewall of container 22 and coupled to liquid transport assembly 26 by a liquid tight closure connection feature 48, such as a threaded coupling, that cooperates with a container connection feature 35 (FIG. 2) on the container 22. In one embodiment, either a rigid cartridge or flexible pouch is inserted into a rigid container with some fitment mechanism to attach the liquid transport assembly 26 and actuator 24.

Figure 4B:
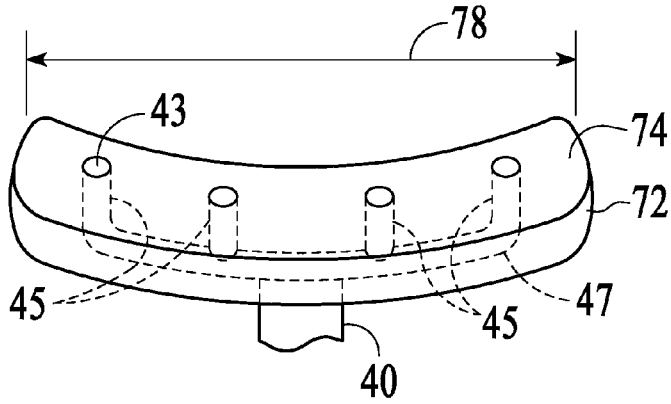
FIG. 4B shows a side view of another embodiment of a liquid distribution subsystem and a suction-flow liquid draw-back subsystem for the dispensing package of the present invention.

Liquid transport assembly 26 includes a hollow dip tube 28 adapted to transport a liquid. An actuator 24, coupled to the liquid transport assembly 26, may be manually reciprocated by a user of dispensing package 20 to move liquid (not shown) contained in container 22 through the dip tube 28 and the discharge channels 45 to the an actuator top 72 of the actuator 24 having an actuator top surface 74 with discharge orifices 25 that terminate the discharge channels 45 (FIG. 4B). In one embodiment, the paths of the various discharge channels 45 are all the same length so that liquid is evenly distributed on the actuator top surface 74 with every liquid transport assembly stroke achieved upon reciprocation of the actuator 24.

When a user pushes actuator 24 down, discharge tube 40 to which actuator 24 is coupled also moves down and liquid is initially discharged from the suction component 55 through discharge tube 40 of the transport assembly 26 shown in FIG. 5A until the bellows top 67 contacts the bellows stops 69 thereby stopping further downward motion of bellows top 67 relative to the bellows base 63.

With further downward movement of the actuator 24, the bellow base 63 moves downward, and the interconnect tube 58 to which it is coupled likewise moves downward. As noted above, the interconnect tube 58 of the pressure component 54 is coupled at one to the piston head 42 and at it other end to the bellows base 63. Thus, the downward movement of interconnect tube 58 causes the pressure component 54 to operate as a piston pump as described above thereby forcing liquid through the interconnect tube 58, past outlet check ball 65 through suction component 55 and out through discharged tube 40 to distribution orifices 25.

After the actuator 24 is released by the user, suction component 55 expands as described above and draws-back any excess liquid on the actuator top surface 74 of the actuator top 72 into the distribution orifices 25, discharge tube 40, and the suction component 55 of the liquid transport assembly 26. At the same time the resiliently compressed pump coil spring 56 of the pressure component 54 biases pump piston 39 upwardly thereby drawing liquid 21 from the container 22 (FIG. 4A) through the dip tube 28 and into the pump chamber 33. Thus, a complete reciprocation cycle of actuator 24 is complete. Additional, reciprocations of the actuator 24 repeat the cycle.

FIG. 5B shows a schematic side cross-sectional view of another liquid transport assembly 26 for the dispensing package of FIG. 4A. In FIG. 5B a second piston pump 57 performs the suction function of the bellow structure of FIG. 5A. The second piston pump includes a second pump chamber 88 and a second pump piston 81, which includes a second piston head 83 having a second piston opening 84 therethrough. Second pump piston 81 is fit within second pump chamber 88 to form a liquid tight seal. As second pump chamber 88 moves downwardly due to reciprocation of actuator 24 and the downward movement of discharge tube 40 as described above in reference to FIG. 4A., liquid is force out a second pump chamber opening 91 in fluid communication tube 40 and flows to the discharge orifices 25 of the actuator 24. Upon release of actuator 24, compressed second pump coil spring 93 returns the second pump chamber 88 to its original position thereby creating suction to draw liquid through discharge orifices 25 as described above with reference to FIG. 4A.

Advantageously, by selection of suitable the various resilient elements such as coil spring or bellows sidewall, the suction components 55 of FIG. 5A and 57 of FIG. 5B may compress before or at the same time as the pressure component 54. Further, any suction component that gets smaller when it is compressed and enlarges again when released can be used in a liquid transport assembly. A flexible resilient bulb or a flexible resilient membrane are other examples of suitable suction components for a liquid transport assembly used with a dispensing package in accordance with the present invention.

FIG. 4B shows a side view of another embodiment of a liquid distribution subsystem and a suction-flow liquid draw-back subsystem for a dispensing package of the present invention. The liquid distribution subsystem of FIG. 4B shows an embodiment of a manifold type distribution subsystem where a plurality of vertical discharge channels 45 are each attached to a respective lengthwise discharge manifold 47 that spans nearly the entire length 78 of the vertical projection of the actuator top 72. In one embodiment of the present invention, four discharge channels 45 are attached to the lengthwise discharge manifold 47 with the four discharge channels 45 substantially equally spaced across the length 78 of the vertical projection of the actuator top 72. Typically, between 2 and 12 discharge channels 45 may be attached to the lengthwise discharge manifold 47.

Discharge channels 45 may fluidly connect the discharge tube 40 with corresponding discharge orifices 43 terminating respective discharge channels 45. The discharge orifices 43 or 25 may span a significant portion of the actuator top 72, thereby providing liquid flow to an area of the actuator top 72 larger than the diameter of the discharge tube 40. Typically, the discharge orifices 43 may span between about 60 to about 95% of the length 78 of the top surface 72.

The liquid distribution subsystem of FIG. 4B further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 4C:
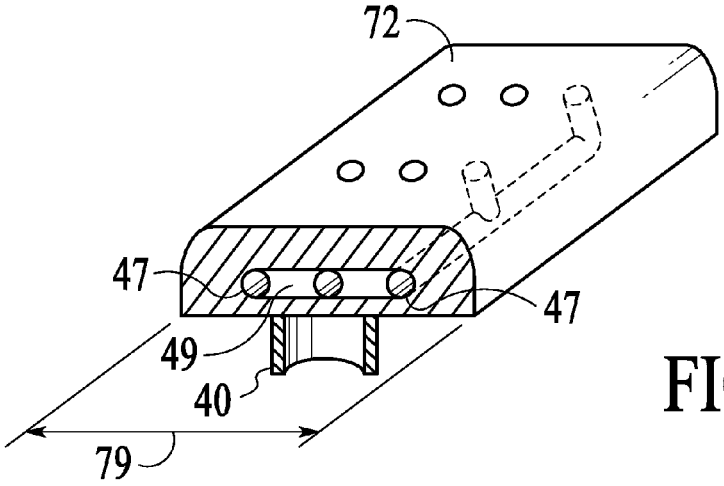
FIG. 4C shows a side cross-sectional view of another embodiment of a liquid distribution subsystem and a suction-flow liquid draw-back subsystem for the dispensing package of the present invention.

FIG. 4C shows a cross-sectional view of an embodiment of a manifold type distribution subsystem where multiple lengthwise manifolds 47 are fluidly connected to the hollow discharge tube 40 via a respective widthwise manifold 49. For example, three lengthwise manifolds 47 may be equally spaced across the width 79 of the actuator top 72. Typically, between 2 and 6 lengthwise manifolds 47 may be fluidly connected to the widthwise manifold 49.

The liquid distribution subsystem of FIG. 4C further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 6:
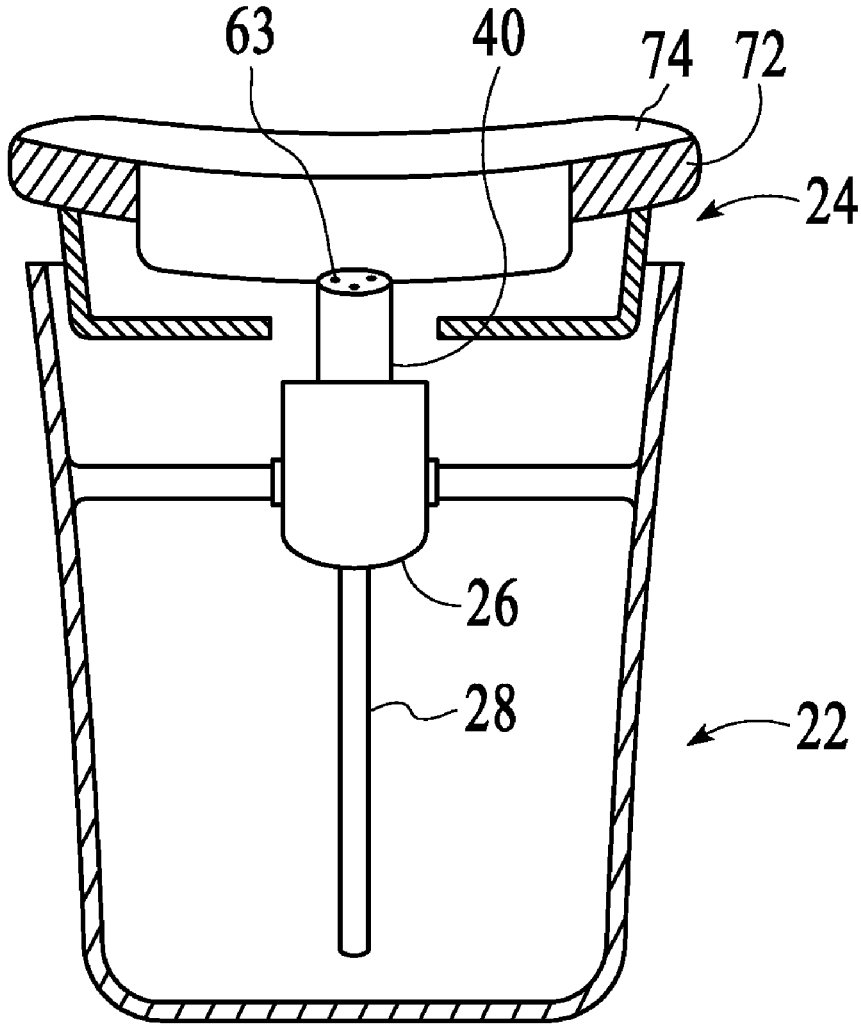
FIG. 6 shows a side cross-sectional view of another embodiment of a dispensing package of the present invention having a liquid distribution subsystem and a suction-flow liquid draw-back subsystem.

FIG. 6 shows a side cross-sectional view of another embodiment of a dispensing package of the present invention having a liquid distribution subsystem and a suction-flow liquid draw-back subsystem.

The liquid distribution subsystem of FIG. 6 further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

FIG. 7 shows a cross-sectional view of a dispensing package 80 that has a distribution pad 82 that remains stationary relative to a container 90. An actuator 84 may be flush with a surface 86 of the distribution pad 82 or alternatively, may extend therefrom, such as about 1/16" to about ½" above the surface 86 of the distribution pad 82. Gaps 87 between the actuator 84 and the distribution pad 82 are present. Thus, the actuator 84 may move relative to the container 90, as shown by arrow 106 when depressed by a user. The dispensing package 80 may include a mechanism such as a trigger mechanism (not shown), as would be known to one of ordinary skill in the art, to translate the stroke of the actuator 84, when depressed by the user, into a stroke of the stem 89 that is longer than the stroke of the actuator 84.

A liquid transport assembly 26 may be actuated by depressing the actuator 84. A stem 89 may connect the actuator 84 with the liquid transport assembly 26. The stem 89 may be connected to a liquid transport assembly piston (not shown in FIG. 7, see FIG. 4A) in the liquid transport assembly 26. In some embodiments of the present invention, more than one stem 89 may connect the actuator 84 with the liquid transport assembly 26. At least one liquid distribution tube 92 may fluidly connect the liquid transport assembly 26 with an orifice 94 at the surface 86 of the distribution pad 82. The liquid distribution tube 92 may split into channels as described above for various embodiments of the dispensing packages described above (see FIG. 4A for example) to distribute liquid from the liquid transport assembly 26 to a plurality of orifices 94. Alternatively, a plurality of liquid distribution tubes 92 may fluidly connect the liquid transport assembly 26 to each of a plurality of orifices 94. A dip tube 96 may fluidly connect a bottom inside 98 of the container 90 with the liquid transport assembly 26.

The liquid distribution subsystem of FIG. 7 further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 8A:
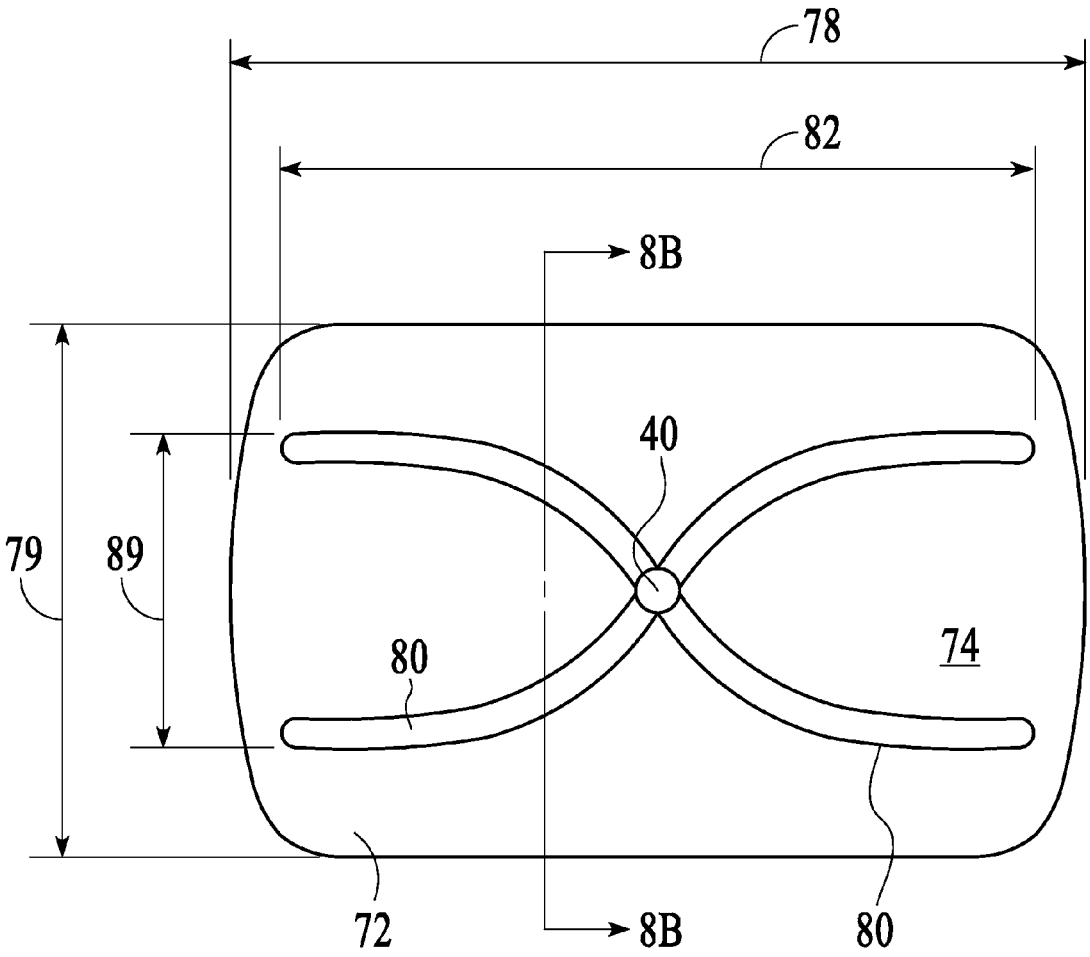
FIG. 8A shows a top view of another embodiment of a liquid distribution subsystem and a suction-flow liquid draw-back subsystem for the dispensing package of the present invention.

FIG. 8A shows a top view of another embodiment of a liquid distribution subsystem and a suction-flow liquid draw-back subsystem for the dispensing package of the present invention. The embodiment of FIG. 8A shows a surface distribution channel type liquid distribution subsystem having a surface distribution channel 80 along the top surface 74 of the actuator top 72. Liquid enters the surface distribution channel 80 from the discharge tube 40 when the actuator 74 is depressed. The surface distribution channel 80 may span a portion of the actuator top surface 74. For example, the maximum length 82 of the surface distribution channel 80 across the top surface 74 may be from about 60 to about 95% of the length 78 of the top surface 74. Similarly, the maximum width 89 of the surface distribution channel 80 across the top surface 74 may be from about 60 to about 95% of the width 79 of the top surface 74.

Figure 8B:
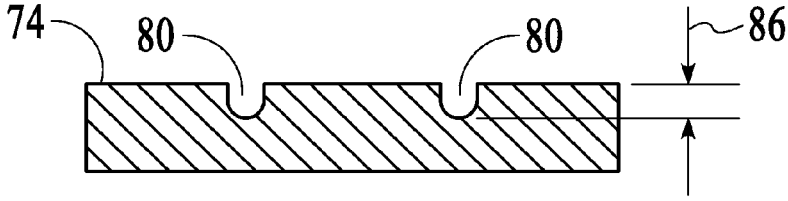
FIG. 8B shows a side cross-sectional view along line 8B-8B of FIG. 8A.

FIG. 8B shows a side cross-sectional view along line 8B-8B of FIG. 8A The surface distribution channel 80 may have a depth 86 from about ½ mm to about 10 mm. The actual depth 86 may be chosen depending on the application. A deeper depth 86 may allow more liquid to be dispensed in a single actuation of the liquid transport assembly and may be useful in those applications where a larger volume of liquid is needed. While FIG. 8A and 8B have an X-shaped surface distribution channel 80, other configurations of the surface distribution channel 80 may be used so long as the surface distribution channel 80 passes over discharge tube 40 and covers an area of the top surface 74 larger than the circumferential area of the discharge tube 40 alone. While the surface distribution channel 80 is shown as being semi-circular, any cross-sectional shape may be useful in the present invention.

The liquid distribution subsystem of FIG. 8A further includes a suction-flow liquid draw-back subsystem for a dispensing package that includes the suction component, such as suction component 55 of FIG. 5A or 56 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 9A:
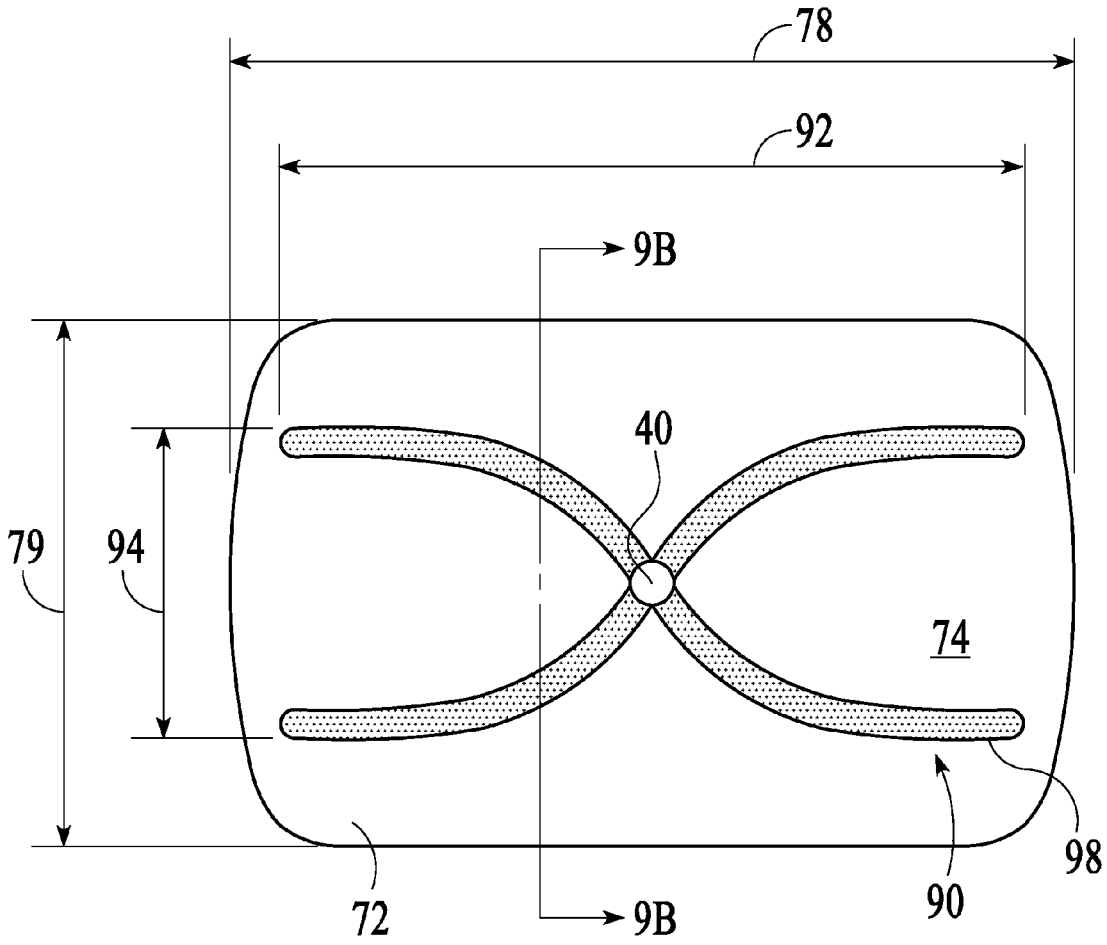
FIG. 9A shows a top view of another embodiment of a liquid distribution subsystem and a suction-flow liquid draw-back subsystem for the dispensing package of the present invention.

FIG. 9A shows an embodiment of a surface distribution channel type liquid distribution subsystem having a surface distribution channel 90 along the top surface 74 of the actuator top 72. Liquid enters the surface distribution channel 90 from the discharge tube 40 when the actuator 74 is depressed. The surface distribution channel 90 may span a portion of the actuator top surface 74. For example, the maximum length 92 of the surface distribution channel 90 across the top surface 74 may be from about 60 to about 95% of the length 78 of the top surface 74. Similarly, the maximum width 94 of the surface distribution channel 90 across the top surface 74 may be from about 60 to about 95% of the width 79 of the top surface 74. Foam 98 may be fitted into the surface distribution channel 90. The foam 98 may be any conventional foam capable of absorbing a liquid and releasing that liquid to a substrate, such as a paper towel, sponge or the like when the foam 98 is compressed with the substrate.

Figure 9B:
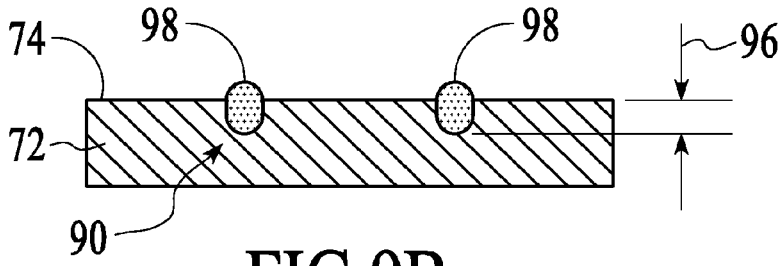
FIG. 9B shows a side cross-sectional view along line 9B-9B of FIG. 9A.

FIG. 9B shows a cross-sectional view along line 9B-9B of FIG. 9A. The surface distribution channel 90 may have a depth 96 from about 1 mm to about 20 mm. The actual depth 96 may be chosen depending on the application. A deeper depth 96 may allow more liquid to be dispensed in a single actuation of the liquid transport assembly and may be useful in those applications where a larger volume of liquid is needed. The foam 98 may be of any shape to fit the contours of the surface distribution channel 90. As shown in FIG. 9B, the foam 98 may have a circular cross-section with at least a portion of the foam 98, typically about 50% of the foam 98, extending above the top surface 74 of the actuator top 72. While FIG. 9A and 9B have an X-shaped surface distribution channel 90, other configurations of the surface distribution channel 90 may be used so long as the surface distribution channel 90 passes over discharge tube 40 and covers an area of the top surface 74 larger than the circumferential area of the discharge tube 40 alone.

The liquid distribution subsystem of FIG. 9A further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 10A:
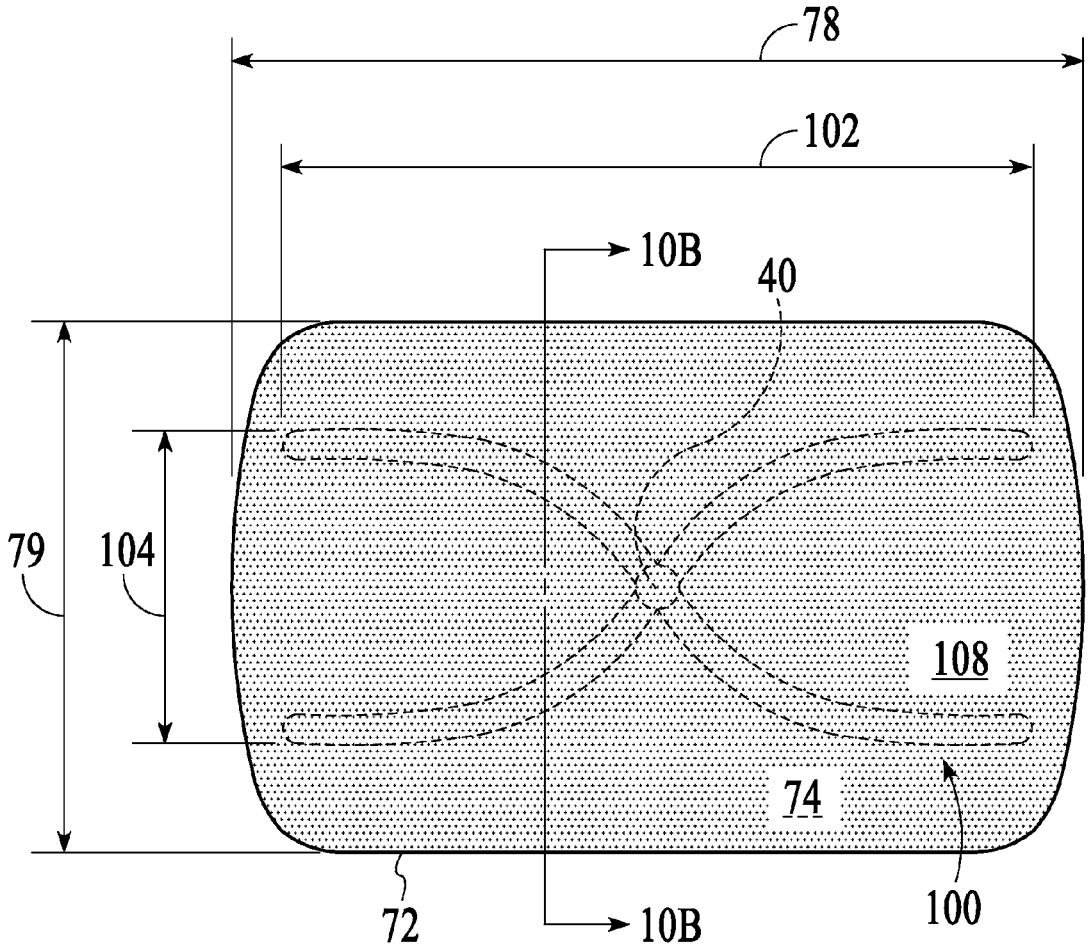
FIG. 10A shows a top view of another embodiment of a liquid distribution subsystem and a suction-flow liquid draw-back subsystem for the dispensing package of the present invention.

FIG. 10A shows an embodiment of a liquid distribution subsystem having a surface distribution channel 100 along a top surface 74 of an actuator top 72. Liquid enters the surface distribution channel 100 from the discharge tube 40 when the actuator 24 (not shown) is depressed. The surface distribution channel 100 may span a portion of the actuator top surface 74. For example, the maximum length 102 of the surface distribution channel 100 across the top surface 74 may be from about 60 to about 95% of the length 78 of the top surface 74. Similarly, the maximum width 104 of the surface distribution channel 100 across the top surface 74 may be from about 60 to about 95% of the width 79 of the top surface 74. A foam covering 108 may cover the top surface 74 such that liquid disbursed into the surface distribution channels 100 may be absorbed by the foam covering 108. When a paper towel, sponge or the like is pressed down on the foam covering 108, the liquid may be released from the foam covering 108 into the paper towel, sponge or the like.

Figure 10B:
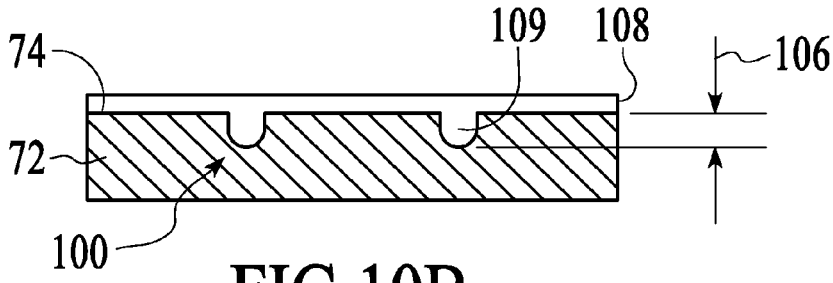
FIG. 10B shows a side cross-sectional view along line 10B-10B of FIG. 10A.

FIG. 10B shows a cross-sectional view along line 10B-10B of FIG. 10A. The surface distribution channel 100 may have a depth 106 from about 1 mm to about 20 mm. The actual depth 106 may be chosen depending on the application. A deeper depth 106 may allow more liquid to be dispensed in a single actuation of the liquid transport assembly and may be useful in those applications where a larger volume of liquid is needed. The foam covering 108 may be of any shape and size to fit on the top surface 74 while covering the surface distribution channel 100. The foam covering 108 may have foam protrusions 109 attached to or formed integrally with the foam covering 108. The foam protrusions 109 are shaped the same as the shape of the surface distribution channel 100 thereby allowing the foam protrusions 109 to fit into the surface distribution channel 100 when the foam covering 108 is placed on the top surface 74. While FIG. 10A and 10B have an X-shaped surface distribution channel 100, other configurations of the surface distribution channel 100 may be used so long as the surface distribution channel 100 passes over discharge tube 40 and covers an area of the top surface 74 larger than the circumferential area of the discharge tube 40 alone.

The liquid distribution subsystem of FIG. 10A further includes a suction-flow liquid draw-back subsystem for a dispensing package that includes the suction component, such as suction component 55 of FIG. 5A or 56 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 11A:
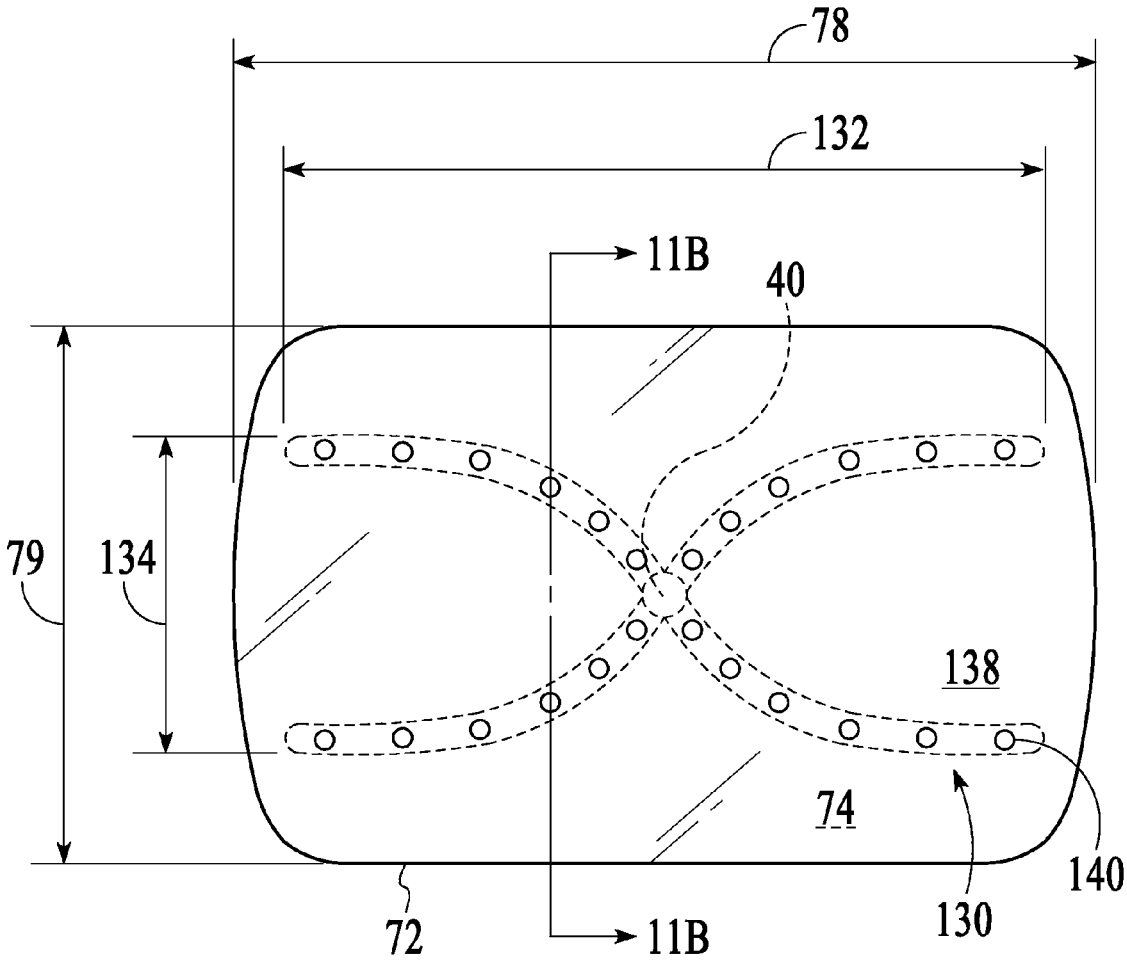
FIG. 11A shows a top view of another embodiment of a liquid distribution subsystem and a suction-flow liquid draw-back subsystem for the dispensing package the present invention.

FIG. 11A shows an embodiment of a liquid distribution subsystem having a surface distribution channel 130 along a top surface 74 of an actuator top 72. Liquid enters the surface distribution channel 130 from a discharge tube 40 when the actuator 24 (not shown) is depressed. The surface distribution channel 130 may span a portion of the actuator top surface 74. For example, the maximum length 132 of the surface distribution channel 130 across the top surface 74 may be from about 60 to about 95% of the length 78 of the top surface 74. Similarly, the maximum width 134 of the surface distribution channel 130 across the top surface 74 may be from about 60 to about 95% of the width 79 of the top surface 74. A thin layer 138 may be attached to the top surface 74 of the actuator top 72. The thin layer 138 may be made of, for example, polyethylene, polypropylene, polyethylene terephthalate or the like. Holes 140 may be formed in the thin layer 138 to allow liquid to pass from the surface distribution channel 130 to a top surface 142 (FIG. 11B) of the flexible layer 138. Holes 140 are formed directly above the surface distribution channel 130 as shown in FIG. 11A. When the liquid fills the surface distribution channel 130, liquid may then pass through the holes 140 to the top surface 142 of the flexible layer 138.

Figure 11B:
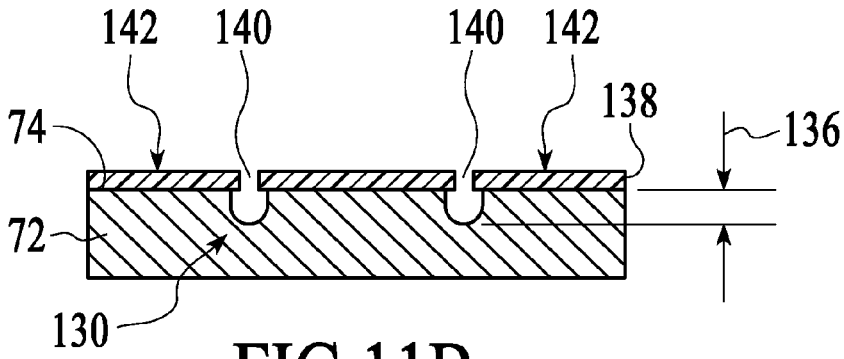
FIG. 11B shows a side cross-sectional view along line 11B-11B of FIG. 11A.

FIG. 11B shows a cross-sectional view along line 11B-11B of FIG. 11A. The surface distribution channel 130 may have a depth 136 from about ½ mm to about 20 mm. The actual depth 136 may be chosen depending on the application. A deeper depth 136 may allow more liquid to be dispensed in a single actuation of the liquid transport assembly and may be useful in those applications where a larger volume of liquid is needed. While FIG. 11A and 11B have an X-shaped surface distribution channel 140, other configurations of the surface distribution channel 140 may be used so long as the surface distribution channel 140 passes over discharge tube 40 and covers an area of the top surface 74 larger than the circumferential area of the discharge tube 40 alone.

The liquid distribution subsystem of FIG. 11A further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Figure 12A:
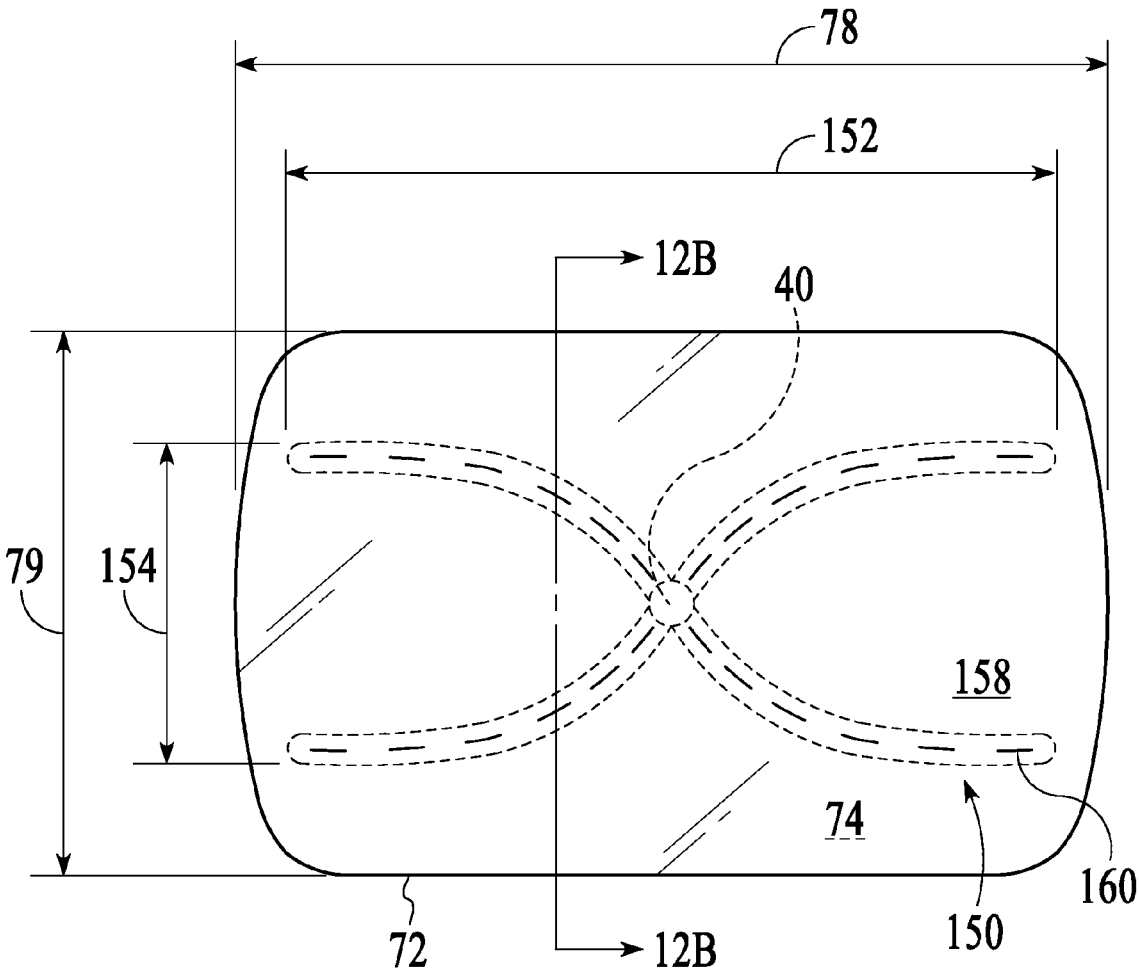
FIG. 12A shows a top view of another embodiment of a liquid distribution subsystem and a suction-flow liquid draw-back subsystem for a dispensing package of the present invention.

FIG. 12A shows an embodiment of a liquid distribution subsystem having a surface distribution channel 150 along a top surface 74 of an actuator top 72. Liquid enters the surface distribution channel 150 from the discharge tube 40 when the actuator 24 (not shown) is depressed. The surface distribution channel 150 may span a portion of the actuator top surface 74. For example, the maximum length 152 of the surface distribution channel 150 across the top surface 74 may be from about 60 to about 95% of the length 78 of the top surface 74. Similarly, the maximum width 154 of the surface distribution channel 150 across the top surface 74 may be from about 60 to about 95% of the width 79 of the top surface 74. A flexible layer 158 may be attached to the top surface 74 of the actuator top 72. The flexible layer 158 may be made of, for example, silicone, thermal plastic elastomer, low density polyethylene or the like. Slits 160 may be formed in the flexible layer 158 to allow liquid to pass from the surface distribution channel 150 to a top surface 162 of the flexible layer 158. Slits 160 are formed over the surface distribution channel 150 as shown in FIG. 4A. When the liquid in the surface distribution channel 150 becomes pressurized, the pressure flexes the flexible layer 158 to open the slits 160 to allow liquid to pass from the surface distribution channel 150 through the slits 160 and to the top surface 162 of the flexible layer 158. This design may prevent the backflow of liquid from the top surface 162 of the flexible layer 158 to the discharge tube 40, thereby potentially contaminating the contents of the container (not shown). A simple linear slit may be used as shown, two or more crossing slits may open with less force and still close when the pressure is released.

Figure 12B:
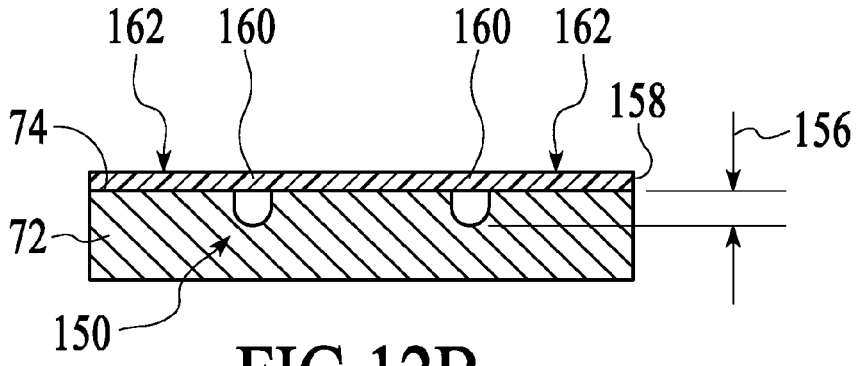
FIG. 12B shows a side cross-sectional view along line 12B-12B of FIG. 12A.

FIG. 12B shows a cross-sectional view along line 12B-12B of FIG. 12A. The surface distribution channel 150 may have a depth 156 from about ½ mm to about 20 mm. The actual depth 156 may be chosen depending on the application. A deeper depth 156 may allow more liquid to be dispensed in a single actuation of the liquid transport assembly and may be useful in those applications where a larger volume of liquid is needed. While FIG. 12A and 12B have an X-shaped surface distribution channel 150, other configuration of the surface distribution channel 150 may be used so long as the surface distribution channel 150 passes over discharge tube 40 and covers an area of the top surface 74 larger than the circumferential area of the discharge tube 40 alone.

The liquid distribution subsystem of FIG. 12A further includes a suction-flow liquid draw-back subsystem for a dispensing package that includes the suction component, such as suction component 55 of FIG. 5A or 57 of FIG. 5B of the present invention. This suction-flow liquid draw-back subsystem operates as described above with reference to FIG. 4A and, as described, utilizes a portion of the liquid distribution subsystem to draw-back liquid for the actuator top surface 74 through the distribution orifices 25.

Additional Functional Features

In one embodiment, additional functional characteristics designed into the container base to offer stability and to encourage consumers to leave the product out on their counters so it is easily accessible. In one embodiment, a means is provided to allow the container to attach to the counter. One such example is a suction cup or other device on the bottom of the container. In addition to standing upright, for example on a counter-top, the dispensing package may be attached to a surface and used with the dispensing package discharge orifices on the bottom, for example attached to the underside of kitchen cabinets.

In one embodiment, the exterior of the dispensing package is resistant to microorganisms. Various anti-microbial agents known in the art can be applied the exterior surface of the dispensing package to impart virucidal, bacterial, and/or germicidal properties thereto. The anti-microbial agent can comprise up to 100% of the surface area of the exterior surface of the dispenser, and in some embodiments, between about 10% to about 80%. The anti-microbial agent can include silver ions. In certain embodiments, a silver-zeolite complex can be utilized to provide controlled release of the anti-microbial agent. One commercially available example of such a time-release anti-microbial agent is sold as a fabric by HEALTH SHIELD® under the name GUARDTEX®, and is constructed from polyester and rayon and contains a silver-zeolite complex. Other suitable silver-containing microbial agents are disclosed in Japanese Unexamined Patent No. JP 10/259325. Moreover, in addition to silver-zeolites, other metal-containing inorganic additives can also be used in the present invention. Examples of such additives include, but are not limited to, copper, zinc, mercury, antimony, lead, bismuth, cadmium, chromium, thallium, or other various additives, such as disclosed in Japanese Patent No. JP 1257124 A and U.S. Pat. No. 5,011,602 to Totani, et al. In some embodiments, the activity of the additive can also be increased, such as described in U.S. Pat. No. 5,900,383 to Davis, et al.

Substrate

Potential substrates or tools that consumers could use with the dispensing package include woven or nonwoven dish cloths, sponges, paper towel, hands, facial tissue, bathroom tissue, paper, napkins, woven and nonwoven substrates, towels, wipes, and cotton balls. The dispensing package could also be used with clothes for stain removal purposes. Suitable substrates can comprise personal, cosmetic or sanitary wipes, baby wipes, hand wipes, wipes used in car cleaning, household or institutional cleaning or maintenance, computer cleaning and maintenance and any other area in which a flexible substrate having a useful liquid treatment composition has application. These substrates (tissues or wipes) can be made from simple nonwovens, complex nonwovens or treated, high-strength durable materials. The substrate can be two-sided or have a barrier so that only one side is wet with the composition upon use. Such substrates are described in U.S. Pat. App. 2005/0079987 to Cartwright et al.

Compositions

The composition can contain virtually any useful liquid compositions. Simple liquids such as water, alcohol, solvent, etc. can be useful in a variety of end uses, particularly cleaning and simple wiping applications. The liquid can be a simple cleaner, maintenance item or a personal care liquid suitable for dermatological contact with an adult, child or infant. Such compositions can be used in hospitals, schools, offices, kitchens, secretarial stations, etc. The compositions can also comprise more complex liquids in the forms of solutions, suspensions or emulsions of active materials in a liquid base. In this regard, such compositions can be active materials dissolved in an alcoholic base, aqueous solutions, water in oil emulsions, oil in water emulsions, etc. Such compositions can be cleaning materials, sanitizing materials, or personal care materials intended for contact with human skin, hair, nails, etc. Cleaning compositions used generally for routine cleaning operations not involving contact with human skin can often contain a variety of ingredients including, in aqueous or solvent base, a soil-removing surfactant, sequestrants, perfumes, etc. in relatively well- known formulations. Sanitizing compositions can contain aqueous or alcoholic solutions containing sanitizing materials such as triclosan, hexachlorophene, betadine, quaternary ammonium compounds, oxidizing agents, acidic agents, and other similar materials. Such compositions can be designed for treating or soothing human skin, including moisturizers, cleansing creams and lotions, cleansers for oily skin, deodorants, antiperspirants, baby-care products, sun block, sun screen, cosmetic-removing formula, insect repellent, etc. Moisturizer materials are preparations that reduce water loss or the appearance of water loss from skin. Cleansing creams or lotions can be developed that can permit the formulation to dissolve or lift away soil pigments, grime and dead skin cells. These creams or lotions can also be enhanced to improve removability of makeup and other skin soils. Cleaners for oily skin are often augmented with ethyl alcohol or isopropyl alcohol to increase the ability of the cleaner to remove excess oily residue. Deodorants and antiperspirants often contain, in an aqueous base, dispersions or emulsions comprising aluminum, zinc or zirconium compounds.

The composition may contain one or more additional surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 90%, or from about 0.001% to 50%, or from about 0.01% to 25% by weight.

The compositions may contain suitable organic solvents including, but are not limited to, $C_{1-6}$ alkanols, $C_{1-6}$ diols, $C_{110}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

The compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Suitable organic acid can be selected from the group consisting of citric acid, lactic acid, malic acid, salicylic acid, acetic acid, adipic acid, fumaric acid, hydroxyacetic acid, dehydroacetic acid, glutaric acid, tartaric acid, fumaric acid, succinic acid, propionic acid, aconitic acid, sorbic acid, benzoic acid, gluconic acid, ascorbic acid, alanine, lysine, and mixtures thereof. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/ hydrocarbon blends. Bleaching agents, when used, include, but are not limited to, peracids, hypohalite sources, hydrogen peroxide, and/or sources of hydrogen peroxide. When cleaning food contact surfaces, compositions for use herein may contain only materials that are food grade or GRAS, including, of course, direct food additives affirmed as GRAS, to protect against possible misuse by the consumer.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon® GC, a 5-chloro-2-methyl-4-isothiazolin-3-one, Kathon® ICP, a 2-methyl-4-isothiazolin-3-one, and a blend thereof, and Kathon® 886, a 5-chloro-2-methyl-4-isothiazolin-3-one, all available from Rohm and Haas Company; BRONOPOL®, a 2-bromo-2-nitropropane1,3diol, from Boots Company Ltd., PROXEL® CRL, a propyl-p-hydroxybenzoate, from ICI PLC; NIPASOL® M, an o-phenyl-phenol, $Na^+$ salt, from Nipa Laboratories Ltd., DOWICIDE® A, a 1,2-Benzoisothiazolin-3-one, from Dow Chemical Co., and IRGASAN® DP 200, a 2,4,4'-trichloro-2-hydroxydiphenylether, from Ciba-Geigy A.G.

The compositions can contain antimicrobial agents, including 2-hydroxycarboxylic acids and other ingredients, including quaternary ammonium compounds and phenolics. Non-limiting examples of these quaternary compounds include benzalkonium chlorides and/or substituted benzalkonium chlorides, di(C6-C14)alkyl di-short chain (C1-4 alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-benzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class. Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, basil, fennel, fir, balsam, menthol, ocmea origanum, *Hydastis carradenisis, Berberidaceae daceae, Ratanhiae* and *Curcunta longa*. Also included in this class of natural essential oils are the key chemical components of the plant oils which have been found to provide the antimicrobial benefit. These chemicals include, but are not limited to anethol, catechole, camphene, carvacol, eugenol, eucalyptol, ferulic acid, farnesol, hinokitiol, tropolone, limonene, menthol, methyl salicylate, thymol, terpineol, verbenone, berberine, ratanhiae extract, caryophellene oxide, citronellic acid, curcumin, nerolidol and geraniol. Other suitable antimicrobial actives include antibacterial metal salts. This class generally includes salts of metals in groups 3b-7b, 8 and 3a-5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

The dispenser can be used to transfer a wide variety of compositions to a substrate. These compositions include hard surface cleaners and sanitizers, personal care cleaners and other products, hand sanitizers, dish soap, laundry pre-treater, food products such as marinades, car products such as cleaners or protectants, and baby care products such as baby lotion. Also, suitable are compositions, such as hypochlorite especially dilute (below 500 ppm) hypochlorite, that lack good stability on nonwoven substrates. Other examples of compositions that may lack stability are quaternary ammonium disinfectants or metal ions that can bind to nonwoven substrates.

In one embodiment, the substrate can undergo a color change or other physical property change during the process of application using the dispenser or during the cleaning process. These changes can include color change due to the addition of a colorless cleaner/disinfectant, color change due to the addition of a composition containing a dye, color change when dye is thermochromic, and changes over time as solvent evaporates to cool the wipe, a color change due to reaction of solvent with a pre-bound species (e.g. transition metals) on the wipe, texture changes in the non-woven, and the impact of the using a dyed or patterned non-woven. The composition or substrate can incorporate solvatochromic dyes to indicate the presence of bacteria as described in U.S. Pat. App. 2005/0130253. In one embodiment, the composition contains a dye that interacts with proteins or bacterial on surfaces to indicate whether the surface is substantially free of soil (protein) or bacteria. In one embodiment, the soil or bacteria is detected on the substrate. In one embodiment, the soil or bacteria is detected on the surface. Colorimetric assays utilizing sampling devices for the detection of protein in biological samples are commonly used across various industries (biotech, healthcare, food, etc). These sampling devices require minimal manipulation of the protein-containing samples and allow for rapid qualitative and quantitative results. Among the various available calorimetric protein assays is one disclosed in U.S. Pat. No. 4,839,295 to Smith, incorporated herein in its entirety, that utilizes a Bicinchonic Acid (BCA) protein assay. This assay is based on the initial complexation of Copper [II], hereinafter $Cu^{++}$ or cupric ion, with protein peptides under alkaline conditions, with the reduction to Copper [I], hereinafter $Cu^{I}$ or the cuprous ion, in a concentration-dependent manner. The ligand BCA is then added in excess, and a purple color develops (562 nm peak absorbance) upon binding of BCA with $Cu^{+}$. Suitable detection devices are described in U.S. patent application Ser. No. 11/397,522 to Cumberland et al. filed Apr. 3, 2006 and U.S. patent application Ser. No. 11/427,469 to Cumberland et al. filed Jun. 29, 2006.

Methods of Use

Consumers enjoy the ease of use of the invention for reasons such as it utilizes cleaners differently, provides control such as no overspray, can be used one-handed, is compatible with wide variety of substrates, utilizes direct application so that no particles are aerosolized into the air, allows easy multi-tasking with other household activities, and is not limited by number of doses or wipes. Because of this flexibility, the consumer has more control to make the exact use conditions suitable to the task.

The dispensing package can be used as a one-handed method of cleaning a surface, where the consumer grabs a substrate in her hand, pushes the substrate down on the reciprocating actuator top of the dispensing package with her hand, allows the actuator top to move down and discharge a cleaning composition from the dispensing package to the substrate, and wipes the surface with the substrate. The substrate can be a paper towel, facial tissue, sheet of toilet tissue, a napkin, a sponge, a towel, the consumer's fingers or any other suitable woven or nonwoven substrate. Because the cleaning task takes only one hand, the other hand is free to perform another activity, such as holding a telephone, eating a snack and the task can be done quickly and easily without carrying the dispensing package to the area of the task.

Because the consumer is unfamiliar with the one-handed method of cleaning a surface, certain use indications on the dispensing package, any exterior packaging, or on advertising may be necessary to provide the consumer instant instruction on the use of the dispensing package. In one embodiment, a hand is depicted over the dispensing package. In another embodiment, a hand holding a substrate is depicted over the dispensing package.

This method of cleaning of the invention has several advantages. If the consumer is preparing dinner and using one hand to contact raw food such as chicken that may contain microorganisms, then the consumer can use the other hand to do one-handed cleaning and disinfection of the food preparation surface, such as a countertop. Using a traditional cleaning product, such as a spray bottle and paper towel, the consumer picks up the spray bottle with the hand that has been potentially contaminated with microorganisms and transfers those microorganisms to the spray bottle. If the spray bottle or other product dispenser is contaminated with microorganisms, then the consumer can pick up and transfer microorganisms from the product dispenser. In the case of the one-handed method of the invention, the consumer contacts the product dispenser only at the actuator component which dispenses the disinfecting composition. In this case, there is less likelihood of transmission of microorganisms from dispenser to hands or from hands to dispenser.

Another advantage of the method and package of the present invention is control during delivery of the composition. With traditional spray dispensers, the consumer must attempt to fit the spray pattern of the spray bottle dispenser to the area to be cleaned. Frequently, the cleaning surface contains additional items, such as food or decorative items, which the consumer may not wish to contact with the cleaning composition. With the method and dispensing package of the invention, the consumer can controllably apply the composition to the substrate and then controllably apply the substrate containing the composition to the cleaning surface. If the consumer were to try spraying the substrate with a traditional spray dispenser, then some of the composition would be aerosolized into the air and some of the composition would miss the substrate and contact other surfaces such as the hand or food items.

Another area of concern for consumers is microorganism contaminated surfaces within the bathroom, especially around the toilet area. Consumers have ready access to toilet tissue but no ready mechanism to use it for spot cleaning. The method of the invention allows the consumer to use toilet tissue, which has limited wet strength and scrubbing strength, to spot clean surfaces around the toilet and other bathroom surfaces without using two hands and without having to pick up the dispensing package. With a suitable composition within the dispensing package, the consumer may also use the dispensing package and method of the invention for personal hygiene use.

With traditional dispensers such as trigger sprayers, the consumer has limited ability to control the pattern of dispensing the composition onto a surface or a substrate. In one case, the substrate, such as sponges, may be rectangular and the dispensing package may deliver a circular application of product. To effectively apply product to a substrate, such as a sponge, it may be desirable to apply the composition in a rectangular or oval fashion, where the applied product is dispersed more in one dimension than in the other dimension.

Additionally, with the hand or a paper towel in a hand or a toilet tissue in a hand, it may also be desirable to apply the composition to the substrate in a non-circular fashion or where one dimension is greater than another. The method of the invention has the advantage that with a properly designed actuator component and discharge orifices in the activator component, it may be possible to apply a non-circular pattern with one hand motion.

Some suitable substrates will not be stable long-term to all suitable compositions, for example toilet tissue or a sheet of facial tissue quickly loses its tensile strength when saturated with cleaning composition. Therefore, it is most suitable to wet the toilet tissue or facial tissue just before use. In some cases, the substrate loses at least 40%, or 50%, or 60%, or 70%, or 80%, or 90% peak dry tensile strength in machine or cross direction upon being loaded to full saturation with the composition. Peak dry tensile strength is the maximum load that a substrate can bear before breaking\rupturing under tension. With the method of the invention, these substrates may be useful for spot cleaning.

Other compositions are not stable on typical substrates, for example hypochlorite, especially dilute hypochlorite, is not storage stable on most nonwoven substrates as described in U.S. Pat. No. 7,008,600 to Katsigras et al. Additionally, compositions of very high or low pH are not generally storage stable on wipes or paper towels. Disinfectant compositions containing quaternary ammonium disinfectants or other cationic disinfectants bind to most nonwovens, especially cellulosic nonwovens, on storage so that they are not effectively released. The extent of binding can be measured by a quaternary recovery measurement on the wet substrate. The liquid squozate is acquired from the substrate by centrifugation after a seven day minimum requisite time of substrate-lotion equilibration. Substrates are put into a centrifuged tube for analysis, centrifuged at 3000 rpm for 15 min, and the liquid analyzed by HPLC. At equilibrium, the quaternary disinfectant show substantial binding to the substrate, for example, at least 10%, or 20%, or 30%, or 40%, or 50% by weight. However, the method of the invention, since it is quick and easy, lends itself to use of unstable substrates and unstable compositions, which may not be suitable under other methods of use.

The present invention relates to disinfecting compositions which can be used to disinfect various surfaces including inanimate surfaces such as hard surfaces like walls, tiles, floors, countertops, tables, glass, bathroom surfaces, and kitchen surfaces. The hard-surfaces to treat with the compositions herein are those typically found in houses like kitchens, bathrooms, e.g., tiles, walls, floors, chrome, glass, smooth vinyl, any plastic, plasticized wood, table top, sinks, cooker tops, dishes, sanitary fittings such as sinks, showers, shower curtains, wash basins, toilets and the like. Hard-surfaces also include household appliances including, but not limited to, refrigerators, freezers, washing machines, automatic dryers, ovens, microwave ovens, dishwashers and so on.

The dispensing package can be used around the house, for example, on kitchen or bathroom surfaces. The dispensing package can be used in public places, for example, in schools and school classrooms. For use around food, a food safe cleaner or disinfectant is suitable. The dispensing package allows the user to quickly apply a sanitizing or cleaning solution to everyday cleaning tools, such as sponges, paper towels, toilet paper, facial tissue, etc. When applied, the sanitizing or cleaning solution transforms the everyday cleaning tool into effective cleaning or sanitizing tools.

Additional Embodiments

In one embodiment, the dispensing package is both a gel and mist cleaner. This dispenser is a dual dispensing cleaner that allows you to dispense one cleaner or two different cleaners in two different forms, a gel and a mist or spray. The package has a gel liquid transport assembly on top that works with a top actuator component as described previously and a liquid misting sprayer on the side. The unit contains one cleaning bottle and optionally a wall mounting base and attachments. To use this embodiment, press and pump your paper towel on the cleaning gel actuator component. To use the misting spray, squeeze the trigger on the side.

In one embodiment, the dispensing package is a discreet and mountable cleaner dispenser. This package is a mountable cleaning product package with a press and pump dispenser. The package is thin and discreet, about the size of a flattened tissue box. It can be mounted horizontally or vertically with adhesive to surface of your choice (e.g., under cabinets, side of counter, side of toilet tank, etc.). The unit contains one dispensing package with adhesive back. In another embodiment, the dispensing package is a hangable cleaner that can be hung anywhere (e.g., shower door/curtain rod, towel rack, kitchen cabinet, shower head, etc.) with the hook on top.

In one embodiment, the dispensing package is a mountable or counter standing dispenser that automatically dispenses the composition onto your paper towel, toilet paper, sponge, rag, etc. A sensor on the dispensing package works to activate the actuator component when you hold your paper towel, toilet paper, sponge, rag, etc. under or over the actuator component. The unit package can contain wall-mounting and counter-holding suction cups, dispensing machine, refillable cleaner cartridge and battery. In one embodiment, this dispensing package is plugged into an outlet to run the sensor and liquid transport assembly.

In one embodiment, the product or package contains directions to store the substrate on top of the package, for example a sponge on top of dispensing package actuator. In one embodiment, the product or package includes the dispensing package and substrates sold together, for example paper towels with the dispensing package. In one embodiment, several dispensing packages are bundled in multi-packs, for example a dispensing package containing dish soap and a dispensing package containing a kitchen cleaner. In one example, the dispensing package is sold with one or more refills.

While this detailed description includes specific examples according to the invention, those skilled in the art will appreciate that there are many variations of these examples that would nevertheless fall within the general scope of the invention and for which protection is sought in the appended claims.

What is claimed is:

1. A liquid dispensing package comprising:

a container adapted to contain a liquid;

an actuator having an actuator top having an actuator top surface with at least one discharge orifice in fluid communication with the container to permit flow of liquid from the container to the actuator top surface upon downward motion of the actuator;

a liquid transport assembly coupled to and in fluid communication with the container and in fluid communication with the at least one discharge orifice; and the liquid transport assembly including a piston pump and a bellows suction component, said bellows suction component in fluid communication at a lower end with the piston pump and at an upper end with the at least one discharger orifice;

wherein the at least one discharge orifice permits draw-back of liquid from the top surface of the actuator through the at least one discharge orifice upon upward motion of the actuator and an associated expansion of the bellows suction component.

2. The liquid dispensing package according to claim 1 where in the draw-back of liquid from the actuator top surface is excess liquid not absorbed on a substrate.

3. The liquid dispensing package according to claim 1 wherein the liquid distribution system is selected from the group consisting of a manifold distribution subsystem and a surface distribution channel distribution subsystem.

* * * * *